US006534258B2

(12) United States Patent
Oyamada et al.

(10) Patent No.: US 6,534,258 B2
(45) Date of Patent: Mar. 18, 2003

(54) METHOD FOR PRODUCING GRAINS OF ALIPHATIC ACID SILVER SALT AND THERMALLY PROCESSED IMAGE RECORDING MATERIAL

(75) Inventors: Takayoshi Oyamada, Kanagawa (JP); Naoyuki Kawanishi, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/730,725

(22) Filed: Dec. 7, 2000

(65) Prior Publication Data

US 2001/0018170 A1 Aug. 30, 2001

(30) Foreign Application Priority Data

Dec. 7, 1999 (JP) ..... 11-348230

(51) Int. Cl.[7] ..... G03C 1/00
(52) U.S. Cl. ..... 430/620; 554/74
(58) Field of Search ..... 430/620, 617, 430/619; 554/74

(56) References Cited

U.S. PATENT DOCUMENTS 4,273,723 A 6/1981 Hayashi et al.
6,143,481 A 11/2000 Uytterhoeven et al.
6,183,947 B1 * 2/2001 Ito

FOREIGN PATENT DOCUMENTS

JP 5540607 3/1980
JP 9127643 5/1997

* cited by examiner

*Primary Examiner*—Thorl Chea
(74) *Attorney, Agent, or Firm*—Birch, Stewart, Kolasch & Birch, LLP

(57) ABSTRACT

A method for producing grains of aliphatic acid silver salt by mixing a solution containing silver ions and a solution of aliphatic acid alkali metal salt to attain reaction of them, wherein (1) 95–100% of the total molar number to be added of the aliphatic acid alkali metal salt is added under a condition that dilution factor of the solution of aliphatic acid alkali metal salt becomes 10-fold or higher at 1 second after the addition, (2) 95–100% of the total amount to be added of silver in the solution containing silver ions is added under a condition that dilution factor of the solution containing silver ions becomes 20-fold or higher at 1 second after the addition, and (3) 50–100% of the total amount to be added of the solution of aliphatic acid alkali metal salt is added simultaneously with the solution containing silver ions. According to the present invention, there is provided a method for producing grains of aliphatic acid silver salt, which show excellent fog prevention ability, in addition, excellent fog prevention ability even after time lapse, when used in a thermally processed image recording material.

18 Claims, 1 Drawing Sheet

METHOD FOR PRODUCING GRAINS OF ALIPHATIC ACID SILVER SALT AND THERMALLY PROCESSED IMAGE RECORDING MATERIAL

FIELD OF THE INVENTION

The present invention relates to a method for producing grains of aliphatic acid silver salt and a thermally processed image recording material which utilizes grains of aliphatic acid silver salt produced by the production method. The thermally processed image recording material of the present invention is characterized in that, in particular, it causes low fog and provides good images for diagnosis.

BACKGROUND OF THE INVENTION

A large number of photosensitive materials are known which have a photosensitive layer on a support and form image by imaging exposure. Examples of a system that enables environmental conservation or simplification of image formation includes a technique of forming an image by heat development.

In recent years, reduction of amount of waste processing solutions is strongly desired in the photographic art field and the medical diagnosis field from the standpoints of environmental protection and space savings. Therefore, techniques relating to thermally processed image recording materials (photothermographic materials) for use in photographic-art processes and medical diagnosis are required which enables efficient exposure by a laser beam and formation of a clear black image having high resolution and sharpness. The thermally processed image recording materials can provide users with a simple and non-polluting heat development processing system that eliminates the use of solution-type processing chemicals.

Methods for forming an image by heat development are described, for example, in U.S. Pat. Nos. 3,152,904 and 3,457,075 and D. Klosterboer, Imaging Processes and Materials, "Thermally Processed Silver Systems", Neblette, 8th ed., compiled by J. Sturge, V. Walworth and A. Shepp, Chapter 9, p.279, (1989). The thermally processed image recording material contains a reducible light-insensitive silver source (e.g., organic silver salt), a photocatalyst (e.g., silver halide) in a catalytically active amount, and a reducing agent for silver, which are usually dispersed in an organic binder matrix. This thermally processed image recording material is stable at an ambient temperature, but when the material is heated at a high temperature (e.g., 80. C. or higher) after light exposure, silver is produced through an oxidation-reduction reaction between the reducible silver source (which functions as an oxidizing agent) and the reducing agent. The oxidation-reduction reaction is accelerated by catalytic action of a latent image generated upon exposure. The silver produced by the reaction of the reducible silver salt in the exposed region provides a black image and this presents a contrast to the non-exposure region to form an image.

The silver source used in these systems is generally an aliphatic acid silver salt, and various methods for producing it are known. For example, there can be mentioned the method of preparing a silver salt of an organic acid under coexistence of water and a hardly water-soluble solvent as disclosed in Japanese Patent Laid-open Publication (Kokai, hereinafter referred to as JP-A-49-93310, JP-A-49-94619 and JP-A-53-68702, the method of preparing a silver salt of an organic acid in an aqueous solution as disclosed in JP-A-53-31611, JP-A-54-4117 and JP-A-54-46709, the method of preparing a silver salt of an organic acid in an organic solvent as disclosed in JP-A-57-186745, JP-A-47-9432 and U.S. Pat. No. 3,700,458 and so forth. Basically, the preparation is carried out by heating an aliphatic acid to a temperature higher than its melting point to dissolve it in water, adding sodium hydroxide or an alkali metal salt with vigorous stirring, and then adding silver nitrate in order to convert the alkali soap into silver soap.

Such alkali soap forms micelles in an aqueous solution, and gives a solution of whitely turbid appearance. The reaction from alkali soap in such a micelle state to the silver soap often suffers from problems concerning production stability. Therefore, as a method for obtaining the alkali soap as a uniform solution, a method of using a mixed solution of water and alcohol as the solvent is disclosed in JP-A-55-40607.

Further, since alkali soap presents alkalinity, the silver soap will be prepared under a high pH condition in the above case. However, addition of silver nitrate into an alkaline solution not only produces silver oxide as a byproduct, but also generates unintended silver nuclei produced by a trace amount of reducing contaminants, which are unavoidable in view of production process and exhibit high reducing property due to the high pH. Such a byproduct is extremely disadvantageous from the viewpoint that it degrades performance of photothermographic materials, in particular, it causes undesired fog and degrades coated surfaces. In this respect, the aforementioned problems are not solved even in the method disclosed in JP-A-55-40607, which aims at obtaining a uniform solution in order to suppress the generation of the byproduct.

Further, JP-A-9-127643 discloses a method for producing a silver salt by simultaneous addition of measured amounts of an alkali metal salt solution and a silver nitrate solution, and refers to simultaneous addition of a solution of sodium behenate in a mixture of water and isopropyl alcohol and a solution of silver nitrate. This method can at least shift the pH of the reaction from the high pH region to a neutral region, and thus it is a preferred method for reducing the generation amount of silver oxide. However, isopropyl alcohol shows weak reducing property, and this makes the method insufficient as a method for completely solving the problem of fog.

Furthermore, upon preparation of non-photosensitive organic acid silver salt, viscosity of reaction mixture becomes extremely high, and therefore it is very difficult to dilute a liquid added during the preparation.

SUMMARY OF THE INVENTION

In view of the problems of the prior art, an object of the present invention is to provide a method for producing grains of aliphatic acid silver salt, which show excellent fog prevention ability, in addition, excellent fog prevention ability even after time lapse, and a thermally processed image recording material which utilizes grains of aliphatic acid silver salt produced by such a method.

The inventors of the present invention assiduously studied in order to achieve the aforementioned object. As a result, they found that an excellent effect to be sought was obtained by the following method. Thus, the present invention has been accomplished.

That is, the present invention provides a method for producing grains of aliphatic acid silver salt by mixing a solution containing silver ions and a solution of aliphatic acid alkali metal salt to attain reaction of them, wherein (1)

95–100% of the total molar number to be added of the aliphatic acid alkali metal salt is added under a condition that dilution factor of the solution of aliphatic acid alkali metal salt becomes 10-fold or higher at 1 second after the addition, (2) 95–100% of the total amount to be added of silver in the solution containing silver ions is added under a condition that dilution factor of the solution containing silver ions becomes 20-fold or higher at 1 second after the addition, and (3) 50–100% of the total amount to be added of the solution of aliphatic acid alkali metal salt is added simultaneously with the solution containing silver ions.

In the production method of the present invention, it is preferred that the solution containing silver ions and the solution of aliphatic acid alkali metal salt are added to a closed mixing means to attain the reaction. Further, it is also preferred that the dilution factor of the solution of aliphatic acid alkali metal salt is 15-fold or higher, and the dilution factor of the solution containing silver ions is 50-fold or higher.

The present invention also provides a thermally processed image recording material comprising a reducing agent, binder, and grains of aliphatic acid silver salt on a support, wherein the grains of aliphatic acid silver salt are produced by the aforementioned production method. The thermally processed image recording material of the present invention preferably contains photosensitive silver halide.

In the present specification, "-" indicates a range including numerical values mentioned before and after it as the minimum and maximum values, respectively.

PREFERRED EMBODIMENT OF THE INVENTION

The method for producing grains of aliphatic acid silver salt and the thermally processed image recording material of the present invention will be explained in detail below.

In the production method of the present invention, grains of aliphatic acid silver salt is produced by mixing a solution containing silver ions and a solution of aliphatic acid alkali metal salt to attain reaction of them. The reaction is usually advanced by adding each solution placed beforehand in the reaction bath (reaction field) . A solvent is preferably added beforehand into the reaction bath, and the solvent may be any of water, organic solvent and mixture of water and organic solvent. The solvent is preferably a mixture of water and organic solvent.

The aliphatic acid used in the present invention is stable at an ambient temperature as a silver salt, but when its silver salt is heated at 80. C. or higher in the presence of a light exposed photocatalyst (e.g., latent images of photosensitive silver halide) and a reducing agent, it produces a silver image. The aliphatic acid used in the present invention is a long chain aliphatic carboxylic acid containing preferably 10–30 carbon atoms, more preferably 12–26 carbon atoms. Preferred examples of the aliphatic carboxylic acid include cerotic acid, lignoceric acid, behenic acid, erucic acid, arachidic acid, stearic acid, oleic acid, lauric acid, caproic acid, myristic acid, palmitic acid, maleic acid, fumaric acid, tartaric acid, linolic acid, butyric acid, camphoric acid and mixtures thereof.

As the alkali metal that constitutes the aliphatic acid alkali metal salt used for the present invention, Na, K and Li are specifically preferred. The aliphatic acid alkali metal salt is obtained by treating the aliphatic acid with an alkali. Specifically, it is prepared by adding NaOH or KOH to the aliphatic acid. In this treatment, it is preferable to use the alkali in an amount less than the equivalent of the aliphatic acid to remain unreacted aliphatic acid. In this case, the amount of the remaining aliphatic acid is 3–50 mole %, preferably 3–30 mole %, with respect to the total aliphatic acid. Further, it may be prepared by, after adding an alkali in an amount exceeding the desired amount, adding an acid such as nitric acid and sulfuric acid to neutralize excessive alkali substance.

The concentration of the aliphatic acid alkali metal salt in the aliphatic acid alkali metal salt solution used for the present invention is 5–50 weight %, preferably 7–45 weight %, further preferably 10–40 weight %. As the solvent used for the solution of aliphatic acid alkali metal salt used for the present invention, water, an organic solvent or a mixture of water and an organic solvent is preferred. In the solution of aliphatic acid alkali metal salt used for the present invention, it is preferred that the organic solvent is contained in an amount of preferably 3–70 volume %, more preferably 5–50 volume %, based on the volume of water. In this case, since the optimum solvent volume changes depending on the reaction temperature, the optimum amount can be determined trial-and-error basis.

Although the solution containing silver ions used for the present invention is not particularly limited so long as it is a solution containing silver ions, a solution of silver nitrate is especially preferred. Although the silver ion concentration in the solution may be arbitrarily determined, it is preferably 0.03–6.5 mol/L, more preferably 0.1–5 mol/L.

As the solvent of the solution containing silver ions, water, an organic solvent or a mixture of water and organic solvent is preferred. It may contain a tertiary alcohol having 4–6 carbon atoms. In such a case, the tertiary alcohol consists of 70 volume % or less, preferably 50 volume % or less, relative to the total volume of the aqueous solution of a water-soluble silver salt.

pH of the solution containing silver ions used for the present invention is preferably 1–6, further preferably 1.5–4. Further, for pH adjustment, an acid or an alkali may be added. Kinds of acid and alkali are not particularly limited.

In the method for producing grains of aliphatic acid silver salt of the present invention, the dilution factor of the solution of aliphatic acid alkali metal salt at 1 second after the addition should be 15-fold or higher, preferably 10-fold or higher, for 95–100% of the total molar number to be added of the aliphatic acid alkali metal salt. The upper limit of the dilution factor is preferably about 2000-fold, more preferably about 1000-fold.

In the method for producing grains of aliphatic acid silver salt of the present invention, the dilution factor of the solution containing silver ions at 1 second after the addition should be 20-fold or higher, preferably 50-fold or higher, for 95–100% of the total amount to be added of silver in the solution containing silver ions. The upper limit of the dilution factor is preferably about 2000-fold, more preferably about 1000-fold.

In this specification, the "dilution factor" of an added solution is calculated as follows. First, 100 ml of a solvent that contributes to the dilution in an actual reaction is prepared, added with 0.1–5 ml of the additive solution, and sufficiently stirred for 10 minutes, and then electric potential and pH are measured to prepare a calibration curve. Thereafter, the solution is added to an actual reaction system, and the electric potential and pH distributions after 1 second were determined. The dilution factor is determined based on the values of a portion where the solution is diluted at the least degree among the measured portions.

However, since the dilution factor varies from one minute to the next depending on the flowing state of a solution, it must be measured various time points during the addition. The aforementioned definition "for 95–100% of the total amount to be added of Ag or the total molar number to be added" may be otherwise defined that portions exhibiting a dilution factor less than the defined dilution factor consist of less than 5%. In the present invention, for convenience, the portions are counted from one exhibiting a higher dilution factor, and a dilution factor observed when 95% of the total amount is added is considered the dilution factor of the corresponding production method (see Examples).

Further, in the method for producing aliphatic acid silver salt grains of the present invention, as for the addition of the solution containing silver ions, it is preferred that 50–99%, preferably 70–99%, of the total amount to be added of silver should be simultaneously added with the solution of aliphatic acid silver salt. By increasing the ratio of silver simultaneously added, the environmental variation during the reaction is suppressed and it becomes possible to prevent unintentional degradation of photographic performance due to variation of shapes and so forth.

Further, when the solution containing silver ions and the aliphatic acid alkali metal salt are mixed to cause the reaction, it is preferred that the preparation is performed by adding first the solution containing silver ions in an amount of 0.1–30% (more preferably 0.5–20%) of the total amount to be added of silver and then adding the aliphatic acid alkali metal salt.

By performing the aforementioned grain formation, hydrophilicity of the organic acid silver salt grains is increased and the film-forming property is improved.

The reaction of the solution containing silver ions and the aliphatic acid alkali metal salt is preferably performed by adding them to closed mixing means to cause the reaction. If the reaction is performed in a closed vessel, there will be obtained an advantage that the dilution factor will not fluctuate in the reaction vessel, and uniform reaction can be attained.

FIG. 1 shows an embodiment of the method for producing non-photosensitive aliphatic acid silver salt used for the present invention, which utilized closed mixing means. In a tank 11 for an additive component 1 and a tank 12 for an additive component 2 shown in the figure, a solution containing silver ions and a solution of aliphatic acid alkali metal salt are stored respectively, which are controlled at predetermined temperatures. A flowmeter 13 for the additive components 1 and a flowmeter 14 for the additive component 2 are flowmeters for measuring flow rates at the time of adding these solutions to the closed mixer 18 which is sealed and filled with a liquid by a pump 15 for the additive component 1 and a pump 16 for the additive components 2. The liquid in which the reaction is completed in the closed mixer 18 is introduced into a heat exchanger 19, quickly cooled, and introduced into a tank 20 for produced liquid. In this embodiment, there is provided, as another component, a pump 17 for recycling the produced liquid, which feed again the prepared aliphatic acid silver salt dispersion to the closed mixer 18.

For practice of the present invention, in order to form aliphatic acid salt grains, it is preferred that at least one of the solution containing silver ions, the solution of aliphatic acid alkali metal salt and the solution placed beforehand in the reaction field should contain an organic solvent in such an amount that the aliphatic acid alkali metal salt provides a substantially transparent solution without forming string-like associated compounds or micelles. Although the solution may contain an organic solvent alone, it is preferably a mixed solution with water.

The organic solvent that can be used in the present invention is not particularly limited so long as it is water-soluble and has the aforementioned properties. However, those degrading photographic performance are not preferred. Preferred are alcohols and acetone, which can be mixed with water, and more preferred are tertiary alcohols having 4–6 carbon atoms.

In the production method of the present invention, the reaction temperature may be raised to perform ripening, after the addition of the solution containing silver ions and/or the solution of aliphatic acid alkali metal salt is completed. The ripening is preferably performed at a temperature higher than the temperature for the addition of the solutions by 0–20° C., preferably 0–10° C. The ripening time is preferably determined trial-and-error basis. This ripening also increases the surface hydrophilicity and improves the film-forming property.

Further, the solution containing silver ions, the solution of an alkali metal salt of an aliphatic acid, or even the liquid existing in the closed reaction vessel to which the both solution is added may be optionally added with compounds of the general formula (1) described in JP-A-62-65035, water-soluble group-containing N-heterocyclic compounds such as those described in JP-A-62-150240, inorganic peroxides such as those described in JP-A-50-101019, sulfur compounds such as those described in JP-A-51-78319, disulfide compounds such as those described in JP-A-57-643, hydrogen peroxide and so forth.

The shape of the aliphatic acid silver salt that can be used for the present invention is not particularly limited. However, scaly aliphatic acid silver salts are preferred for the present invention. Scaly aliphatic acid silver salts are herein defined as follows. A sample of an aliphatic acid silver salt to be analyzed is observed with an electronic microscope, and grains of the salt seen in the field are approximated to rectangular parallelepipeds. The three different edges of each rectangular parallelepiped are represented as a, b and c where a is the shortest, c is the longest, and c and b may be the same. From the shorter edges a and b, x is obtained according to the following equation:

$$x=b/a$$

The values of x are obtained for about 200 grains seen in the field, and an average of them (x (average)) is obtained. Samples that satisfy the requirement of x (average)$\geqq$1.5 are defined to be scaly. Scaly grains preferably satisfy 30$\geqq$x (average)$\geqq$1.5, more preferably 20$\geqq$x (average)$\geqq$2.0. In this connection, acicular (needle-like) grains falls satisfy 1$\leqq$x (average)<1.5.

In scaly grains, it is understood that a corresponds to the thickness of tabular grains of which main planes are defined by the sides of b and c. The average of a is preferably from 0.01 $\mu$m to 0.23 $\mu$m, more preferably from 0.1 $\mu$m to 0.20 $\mu$m. The average of c/b is preferably from 1 to 6, more preferably from 1.05 to 4, even more preferably from 1.1 to 3, particularly preferably from 1.1 to 2.

The grain size distribution of the aliphatic acid silver salt is preferably monodispersed. The term "monodispersed" as used herein means that the percentage of the value obtained by dividing the standard deviation of the length of the short axis or long axis by the length of the short axis or long axis, respectively, is preferably 100% or less, more preferably 80% or less, further preferably 50% or less. The shape of the aliphatic acid silver salt can be determined from a transmission electron microscope image of aliphatic acid silver salt dispersion. Another method for determining the monodispesibility is a method involving obtaining the standard deviation of a volume weight average diameter of the aliphatic acid silver salt. The percentage (coefficient of variation) of the value obtained by dividing the standard deviation by the volume weight average diameter is preferably 100% or less, more preferably 80% or less, further preferably 50% or less. As a measurement method, for example, the grain size (volume weight average diameter) can be determined by irradiating aliphatic acid silver salt dispersed in a solution with a laser ray and determining an autocorrelation function of the fluctuation of the scattered light on the basis of the change in time.

Preferably, the scaly aliphatic acid silver salt for use in the present invention is prepared by reacting an aqueous solution of a water-soluble silver salt with an aqueous solution of an alkali metal salt of an aliphatic acid in an aqueous tertiary alcohol solution in a reaction vessel (the method includes a step of adding the aqueous tertiary alcohol solution containing an alkali metal salt of an aliphatic acid into a liquid already existing in a reaction vessel), wherein the temperature difference between the liquid already existing in the reaction vessel and the aqueous tertiary alcohol solution of an alkali metal salt of an aliphatic acid to be added thereto falls between 20° C. and 85° C. The liquid existing in the reaction vessel in advance is preferably an aqueous solution of a water-soluble silver salt put into the reaction vessel in advance. In a case where the aqueous solution of a water-soluble silver salt is not put into the reaction vessel in advance but is put into the vessel from the start along with an aqueous solution of an alkali metal salt of an organic acid in a tertiary alcohol, the liquid existing in the reaction vessel is water or a mixed solvent of water and a tertiary alcohol, as will be mentioned hereinafter. Even in a case where the aqueous solution of a water-soluble silver salt is put into the reaction vessel in advance, the reaction vessel may contain water or a mixed solvent of water and a tertiary alcohol.

With the temperature difference between the liquid already existing in the reaction vessel and the aqueous tertiary alcohol solution of an alkali metal salt of an aliphatic acid to be added being controlled to fall within the defined range during the addition, the crystal shape of the aliphatic acid silver salt to be formed can favorably controlled.

Temperature of the solution containing silver ions is preferably 0–50° C., more preferably 5–30° C. When an aqueous solution containing water-soluble silver salt and an aqueous tertiary alcohol solution of aliphatic acid alkali metal salt are simultaneously added as will be described below, the temperature is most preferably 5–15° C.

Temperature of an aqueous tertiary alcohol solution of aliphatic acid alkali metal salt, which is added to a reaction vessel, is preferably 50–90° C., more preferably 60–85° C., most preferably 65–85° C., in order to avoid phenomena of crystallization and solidification of the aliphatic acid alkali metal salt. Further, the temperature is preferably controlled to be a constant temperature within the aforementioned range in order to control the reaction temperature to be constant.

Temperature of the liquid previously existing in the reaction vessel is preferably 5° C. to 75° C., more preferably 5° C. to 60° C., most preferably 10° C. to 50° C. Throughout the entire process of the reaction, the reaction temperature is preferably controlled to be a constant temperature falling within the defined range. As the case may be, however, the reaction temperature may be controlled in some temperature profiles varying within the defined range.

The temperature difference between the aqueous tertiary alcohol solution of an alkali metal salt of an aliphatic acid and the liquid existing in the reaction vessel is preferably 20° C. to 85° C., more preferably 30° C. to 80° C. In this case, it is desirable that the temperature of the aqueous tertiary alcohol solution of an alkali metal salt of an aliphatic acid should be higher than that of the liquid already existing in the reaction vessel.

By performing the process as described above, the rate at which the aqueous tertiary alcohol solution of an alkali metal salt of an aliphatic acid having a higher temperature is rapidly cooled by the reaction vessel and precipitated to give fine crystals, and the rate at which the deposited alkali metal salt is reacted with the water-soluble silver salt to give an aliphatic acid silver salt are both favorably controlled, and therefore the crystal shape, crystal size and crystal size distribution of the aliphatic acid silver salt can be favorably controlled. In addition, the properties of the thermally processed material, in particular, as a photothermographic image recording material, can also be improved.

The reaction vessel may contain a solvent in advance, and water is preferably used as the solvent that is contained in advance. A mixed solvent of water and a tertiary alcohol may also be preferably used.

The aqueous tertiary alcohol solution of an alkali metal salt of an aliphatic acid, the aqueous solution of a water-soluble silver salt, or the reaction mixture may optionally be added with a dispersing aid that is soluble in aqueous media. The dispersing aid may be any one capable of dispersing the aliphatic acid silver salt formed. Specific examples thereof include those mentioned below as the dispersing aid for aliphatic acid silver salts.

In the process of producing aliphatic acid silver salt, the salt formed is preferably desalted and dehydrated. The method for desalting and dehydrating the salt is not particularly limited, and well-known conventional methods may be used. For example, preferably used are known filtration methods including centrifugation filtration, suction filtration, ultrafiltration, flocculation by the coagulation method followed by washing with water and so forth. Also preferably used is supernatant removal by centrifugal precipitation. The desalting and dehydration may be performed once or may be repeated. Addition and removal of water may be effected continuously or separately. The desalting and the dehydration are preferably effected to such a degree that the finally removed water should have a conductivity of 300 .S/cm or less, more preferably 100 .S/cm or less, most preferably 60 .S/cm or less. As for the conductivity, although there is no particular lower limit, it may generally be 5 .S/cm or so.

To improve conditions of the coated surface of the photothermographic material, in particular, the thermally processed image recording material, the aliphatic acid silver salt subjected to desalting and dehydration is preferably further added with a dispersing agent and dispersed into a fine dispersion.

As for the method for finely dispersing the aliphatic acid silver salt, for example, it can be mechanically dispersed in the presence of a dispersing aid by a known dispersing apparatus (e.g., high-speed mixer, homogenizer, high-speed impact mill, Banbary mixer, homomixer, kneader, ball mill, vibrating ball mill, planetary ball mill, attriter, sand mill, bead mill, colloid mill, jet mill, roller mill, trone mill, high-speed stone mill etc.).

For obtaining a uniform aliphatic acid silver salt solid dispersion having a high S/N ratio and a small grain size and being free from coagulation, it is preferable to uniformly apply strong force within a range that should not cause breakage or unacceptable temperature increase of the aliphatic acid silver salt grains as the image-forming media. To this end, a dispersion method comprising the steps of converting an aqueous dispersion that contains an aliphatic acid silver salt and an aqueous solution of dispersant into a high-speed flow, and then releasing the pressure, is preferred. In this case, the dispersion medium may be any one so long as the dispersing aid can function in it. However, it preferably consist solely of water, and water may contain an organic solvent in an amount of 20 weight % or less. Further, it is desirable that the aliphatic acid silver salt is dispersed substantially in the absence of a photosensitive silver salt, since the photosensitive silver salt will increase fog and markedly lower sensitivity, if a photosensitive silver salt is present during the dispersion. For the present invention, the amount of the photosensitive silver salt that may be in a dispersion to be dispersed should be 0.1 mole % or less per mole of the aliphatic acid silver salt, and it is preferred that the photosensitive silver salt is not added.

The dispersing apparatuses and techniques used for performing the above-described re-dispersion method are described in detail, for example, in Toshio Kajiuchi and Hiromoto Usui, Bunsan-Kei Rheology to Bunsanka Gijutsu (Rheology of Dispersion System and Dispersion Technology), pp.357–403, Shinzan Sha Shuppan (1991), and Kagaku Kogaku no Shinpo (Progress of Chemical Engineering), vol. 24, pp. 184–185, compiled by Corporation Kagaku Kogakukai Tokai Shibu, Maki Shoten (1990), JP-A-59-49832, U.S. Pat. No. 4,533,254, JP-A-8-137044, JP-A-8-238848, JP-A-2-261525, JP-A-1-94933 and so forth. The re-dispersion method used in the present invention comprises steps of supplying a water dispersion containing at least an aliphatic acid silver salt into a pipeline under a positive pressure by means of a high-pressure pump or the like, passing the dispersion through a narrow slit provided inside the pipeline, and then subjecting the dispersion to rapid pressure reduction to perform fine dispersion.

As for the high-pressure homogenizer, it is generally considered that fine and uniform dispersion can be achieved therein by enhancing (a) "shear force" to be generated at the passage of a dispersoid through a narrow slit (75 .m to 350 .m or so) under high pressure at high speed and (b) "cavitation force" to be generated by the pressure releasing, but without changing the preceding impact force resulting from the liquid-liquid collision or the liquid-wall collision in the high-pressure narrow space. One old example of the dispersion apparatus of this type is a Galling homogenizer. In this apparatus, a liquid to be dispersed introduced under high pressure is converted into a high-speed flow when it is passed through a narrow gap formed on the wall of a cylindrical surface. Then, the flow collides against a surrounding wall with its own force, and is emulsified and dispersed by the impact force. For the liquid-liquid collision mentioned above, for example, there can be mentioned a Y-type chamber of Microfluidizer, a spherical chamber utilizing a spherical check valve such as that described in JP-A-8-103642 mentioned below and so forth. For the liquid-wall collision, there can be mentioned a Z-type chamber of Microfluidizer and so forth. The pressure is generally 100 to 600 kg/cm$^2$, and the flow rate is generally a few meters/sec to 30 meters/sec. In order to increase the dispersion efficiency, some apparatuses are designed wherein the high flow rate area is so modified as to have a serrated configuration, thereby increasing the frequency of collision. Typical examples of such devices are Galling homogenizer, Microfluidizer from Microfluidex International Corporation, Microfluidizer from Mizuho Kogyo Co., Ltd., Nanomizer from Tokushu Kika Kogyo Co., Ltd and so forth. Other examples of such apparatuses are described in JP-A-8-238848, JP-A-8-103642 and U.S. Pat. No. 4,533,254.

In dispersing process of the aliphatic acid silver salt, dispersion having a desired grain size may be obtained by controlling the flow rate, the difference in the pressure before and after at the pressure releasing and the frequency of the processing. From viewpoints of photographic performance and the grain size, the flow rate is preferably from 200 to 600 m/sec and the difference in the pressure at the pressure releasing is preferably from 900 to 3,000 kg/cm$^2$, and more preferably, the flow rate is from 300 to 600 m/sec, and the difference in the pressure at the pressure releasing is from 1,500 to 3,000 kg/cm$^2$. The frequency of the dispersion processing may be appropriately chosen as required, and is usually from 1 to 10 times. From a viewpoint of productivity, the frequency is approximately from 1 to 3 times. The water dispersion under a high pressure is preferably not warmed at a high temperature from viewpoints of dispersibility and photographic performance. At a high temperature above 90° C., a grain size may readily become large and fog may be increased. Accordingly, the water dispersion is preferably kept at a temperature of from 5° C. to 90° C., more preferably from 5° C. to 80° C., particularly preferably from 5° C. to 65° C., by using a cooling apparatus in a step before the conversion into a high-pressure and high-speed flow, or a step after the pressure release, or both of the steps. It is particularly effective to provide the cooling step at the time of dispersion under a high pressure of from 1,500 to 3,000 kg/cm$^2$. The cooling apparatus may be appropriately selected from a double pipe or triple pipe with a static mixer, a multi-tubular exchanger, a coiled heat exchanger and so forth depending on an amount of heat exchange to be required. The size, wall thickness or material of a pipe may be appropriately selected to increase heat exchange efficiency depending on an applied pressure. In addition, depending on an amount of heat exchange, a refrigerant used in the cooling apparatus may be a well water at 20° C. or a chilled water at from 5 to 10° C. cooled by a refrigerator, and if desired, a refrigerant such as ethylene glycol/water at −30° C. may also be used.

When the aliphatic acid silver salt is dispersed into solid fine grains by using a dispersing agent, there can be selected and used, for example, synthetic anion polymers such as polyacrylic acid, acrylic acid copolymer, maleic acid copolymer, maleic acid monoester copolymer and acryloylmethylpropanesulfonic acid copolymer, semisynthetic anionic polymers such as carboxymethyl starch and carboxymethyl cellulose, anionic polymers such as alginic acid and pectic acid, anionic surfactants described in JP-A-52-92716, International Patent Publication WO88/04794 and so forth, the compounds described in JP-A-9-179243, known anionic, nonionic or cationic surface active agents, known polymers such as polyvinyl alcohol, polyvinylpyrrolidone, carboxymethyl cellulose, hydroxypropyl cellulose and hydroxypropylmethyl cellulose, and naturally-occurring polymer compounds such as gelatin. When a solvent is used as the dispersion medium, polyvinyl butyral, butyl ethyl cellulose, methacrylate copolymer, maleic anhydride ester copolymer, polystyrene and butadiene/styrene copolymer and so forth are preferably used.

The dispersing aid is generally mixed with the aliphatic acid silver salt in a form of powder or wet cake before the dispersing process, and fed as slurry into a dispersing apparatus. However, the dispersing aid may also be mixed with the aliphatic acid silver salt beforehand, and then the mixture may be subjected to a treatment such as by heating or with a solvent to form an aliphatic acid silver salt powder or wet cake. The pH may be controlled with a suitable pH modifier before, during or after the dispersing operation.

Other than the mechanical dispersion, the aliphatic acid silver salt can be made into microparticles by roughly dispersing the salt in a solvent through pH control, and then changing the pH in the presence of a dispersing aid. For the operation, an aliphatic solvent may be used as a solvent for the rough dispersion.

The dispersion prepared can be stored with stirring to prevent precipitation of the grains during storage, or stored in a highly viscous state formed by means of a hydrophilic colloids (e.g., a jelly state formed with gelatin). Furthermore, the dispersion may contain a preservative in order to prevent proliferation of microorganisms during storage.

The aliphatic acid silver salt prepared by a method for preparing aliphatic acid silver salts is preferably dispersed in a solvent, and then mixed with an aqueous solution of a photosensitive silver salt to provide a coating solution for photosensitive image-forming media.

In advance of the dispersion operation, the stock solution is preferably roughly dispersed (preparatory dispersion). The rough dispersion may be performed using a known dispersion means (for example, high-speed mixer, homogenizer, high-speed impact mill, Banbary mixer, homomixer, kneader, ball mill, vibrating ball mill, planetary ball mill, attriter, sand mill, bead mill, colloid mill, jet mill, roller mill, trone mill, high-speed stone mill etc.). Other than the mechanical dispersion, the stock solution may be roughly dispersed in a solvent by controlling pH and thereafter formed into fine grains in the presence of a dispersion aid by changing pH. At this time, the solvent used for the rough dispersion may be an organic solvent.

The grain size (volume weight average diameter) in the solid fine grain dispersion of aliphatic acid silver salt can be determined by, for example, irradiating the solid fine grain dispersion dispersed in a solution with a laser ray and determining an autocorrelation function of the fluctuation of the scattered light on the basis of the change in time (volume weight average diameter). The solid fine grain dispersion preferably has an average grain size of 0.05 to 10.0 $\mu$m, more preferably from 0.1 to 5.0 $\mu$m, further preferably from 0.1 to 2.0 $\mu$m.

The aliphatic acid silver salt solid fine grain dispersion preferably used in the present invention comprises at least an aliphatic acid silver salt and water. The ratio of the aliphatic acid silver salt to water is not particularly limited. The aliphatic acid silver salt preferably accounts for from 5 to 50 weight %, more preferably from 10 to 30 weight % of the entire dispersion. The aforementioned dispersing aid is preferably used, but it is preferably used in a minimum amount within the range suitable for attaining a minimum grain size, specifically, in an amount of from 1 to 30 weight %, more preferably from 3 to 15 weight %, based on the aliphatic acid silver salt.

In the present invention, the thermally processed image recording material may be produced by mixing an aliphatic acid silver salt aqueous dispersion and a photosensitive silver salt aqueous dispersion. The mixing ratio of the aliphatic acid silver salt and the photosensitive silver salt may be selected according to the purpose. However, the ratio of the photosensitive silver salt to the aliphatic acid silver salt is preferably from 1 to 30 mole %, more preferably from 3 to 20 mole %, still more preferably from 5 to 15 mole %. In the mixing, two or more aliphatic acid silver salt aqueous dispersions are preferably mixed with two or more photosensitive silver salt aqueous dispersions, so that the photographic properties can be controlled.

The aliphatic acid silver salt may be used in any desired amount in the present invention. However, it is preferably used in an amount of from 0.1 to 5 g/m$^2$, more preferably from 1 to 3 g/m$^2$, in terms of silver.

The photosensitive silver halide that can be used for the present invention is not particularly limited as for the halogen composition, and silver chloride, silver chlorobromide, silver bromide, silver iodobromide, and silver chloroiodobromide may be used. The halide composition may have a uniform distribution in the grains, or the compositions may change stepwise or continuously in the grains. Silver halide grains having a core/shell structure may be preferably used. Core/shell grains having preferably a double to quintuple structure, more preferably a double to quadruple structure may be used. A technique for localizing silver bromide on the surface of silver chloride or silver chlorobromide grains may also be preferably used.

For the preparation of the photosensitive silver halide, methods well known in the art, e.g., the methods described in Research Disclosure, No. 17029 (June, 1978) and U.S. Pat. No. 3,700,458, can be used. More specifically, the silver halide is prepared by the reaction of silver nitrate and soluble halide salt as a silver halide emulsion. For the preparation, it is also possible to allowing a reaction of an aliphatic acid silver salt and halogen ions to cause halogen conversion. It is further possible to add halogen ions during the formation of an aliphatic acid silver salt.

As for a grain size of the photosensitive silver halide, smaller grains are desirable to prevent cloudiness of the photosensitive material after image formation. Specifically, the grain size may preferably be not greater than 0.20 $\mu$m, preferably from 0.01 to 0.15 $\mu$m, more preferably from 0.02 to 0.12 $\mu$m. The term "grain size" used herein means a diameter of a sphere having the same volume as the grain where the silver halide grains are regular crystals in cubic or octahedral form and where the silver halide grains are irregular crystals such as spherical or rod-like grains. Where silver halide grains are tabular grains, the term means the diameter of a circle having the same area as a projected area of the main surface of the tabular grain.

Examples of the form of silver halide grains include a cubic form, octahedral form, tabular form, spherical form, rod-like form and potato-like form. In particular, cubic grains are preferred for the present invention. Silver halide grains having round corners are also preferably used in the present invention. Surface index (Miller index) of outer surfaces of the photosensitive silver halide grains is not particularly limited. However, it is desirable that [100] face be present in a high proportion that can achieve high spectral sensitizing efficiency when a spectral sensitizing dye adsorbed thereto. The proportion of [100] face may be preferably not lower than 50%, more preferably at least 65%, still more preferably at least 80%. The proportion of Miller index [100] face can be determined using the method described in T. Tani, J. Imaging Sci., 29, 165 (1985), where the difference in adsorption of a sensitizing dye to [111] face and [100] face is utilized.

The photosensitive silver halide grain used in the present invention contains a metal or metal complex of Group VIII to Group X in the periodic table of elements (including Group I to Group XVIII). The metal or the center metal of the metal complex of Group VIII to X of the periodic table is preferably rhodium, rhenium, ruthenium, osmium or iridium. The metal complex may be used alone, or two or more complexes of the same or different metals may also be used in combination. The metal complex content is preferably from $1\times10^{-9}$ to $1\times10^{-3}$ mole per mole of silver. Such metal complexes are described in JP-A-11-65021, paragraphs 0018 to 0024.

In the present invention, an iridium compound is preferably contained in the silver halide grains. Examples of the iridium compound include hexachloroiridium, hexammineiridium, trioxalatoiridium, hexacyanoiridium and pentachloronitrosyliridium. The iridium compound is used after dissolving it in water or an appropriate solvent, and a method commonly used for stabilizing the iridium compound solution, more specifically, a method comprising adding an aqueous solution of hydrogen halogenide (e.g., hydrochloric acid, bromic acid, fluoric acid) or halogenated alkali (e.g., KCl, NaCl, KBr, NaBr) may be used. In place of using a water-soluble iridium, separate silver halide grains previously doped with iridium may be added and dissolved at the time of preparation of silver halide. The addition amount of the iridium compound is preferably 1. $10^{-8}$ to 1. $10^{-3}$ mole, more preferably 1. $10^{-7}$ to 5. $10^{-4}$ mole, per mole of silver halide.

Further, metal complexes that can be contained in the silver halide grains used for the present invention (e.g., $[Fe(CN)_6]^{4-}$), desalting methods and chemical sensitization method are described in JP-A-11-84574, paragraphs 0046 to 0050 and JP-A-11-65021, paragraphs 0025 to 0031.

As a sensitizing dye that can be used for the present invention, there can be advantageously selected those sensitizing dyes which can spectrally sensitize silver halide grains within a desired wavelength range after they are adsorbed by the silver halide grains and have spectral sensitivity suitable for spectral characteristics of the light source to be used for exposure. Such sensitizing dyes and addition methods therefor are described in JP-A-11-65021, paragraphs 0103 to 0109 and EP 0803764A1, page 19, line 38 to page 20, line 35, and there can be mentioned the compounds of formula (II) described in JP-A-10-186572. In the present invention, the sensitizing dye is added to the silver halide emulsion preferably during the period after the desalting step and before the coating step, more preferably during the period after the desalting step and before the start of the chemical ripening.

Photosensitive silver halide grains used for the present invention are preferably subjected to chemical sensitization by sulfur sensitization, selenium sensitization or tellurium sensitization. Any known compounds are preferably usable for such sulfur, selenium or tellurium sensitization, and for example, the compounds described in JP-A-7-128768 are usable for that purpose. In the present invention, especially favorable is tellurium sensitization. Tellurium sensitizers usable herein include, for example, diacyltellurides, bis(oxycarbonyl)tellurides, bis(carbamoyl)tellurides, diacylditellurides, bis(oxycarbonyl)ditellurides, bis(carbamoyl)ditellurides, compounds with P═Te bond, tellurocarboxylates, tellurosulfonates, compounds with P-Te bond, tellurocarbonyl compounds, etc. For these, specifically mentioned are the compounds described in JP-A-11-65021, paragraph 0030. Particularly preferred are those disclosed in JP-A-5-313284 as the compounds of the general formulas (II), (III) and (IV).

In the present invention, the chemical sensitization may be performed at any time so long as it is performed after the formation of the grains and before the coating. It may be performed after desalting and (1) before the spectral sensitization, (2) simultaneously with the spectral sensitization, (3) after the spectral sensitization, (4) immediately before the coating, or the like. It is particularly preferably performed after spectral sensitization.

The amount of the sulfur, selenium or tellurium sensitizer for use in the present invention varies depending on the type of the silver halide grains to be used, the condition for chemical ripening etc., but may fall generally between $10^{-8}$ and $10^{-2}$ mole, preferably between $10^{-7}$ and $10^{-3}$ mole or so, per mol of the silver halide. Although the conditions for the chemical sensitization are not particularly limited in the present invention, pH falls between 5 and 8, the pAg falls between 6 and 11, preferably between 7 and 10, and the temperature falls between 40 and 95° C., preferably between 44 and 70° C.

In the thermally processed image recording material of the present invention, one kind of photosensitive silver halide emulsion may be used or two or more different emulsions (for example, those having different average grain sizes, different halogen compositions, different crystal habits or different chemical sensitization conditions) may be used in combination. By using plural photosensitive silver halides having different sensitivities, contrast can be controlled. Examples of the techniques in the art include those mentioned in JP-A-57-119341, JP-A-53-106125, JP-A-47-3929, JP-A-48-55730, JP-A-46-5187, JP-A-50-73627, JP-A-57-150841 and so forth. Each emulsion may preferably have sensitivity difference of 0.2 log E or higher.

The amount of the photosensitive silver halide is preferably 0.03 to 0.6 g/m$^2$, more preferably 0.05 to 0.4 g/m$^2$, most preferably 0.1 to 0.4 g/m$^2$, as the amount of coated silver per 1 m$^2$ of a photosensitive material. The amount of the photosensitive silver halide per mole of the aliphatic acid silver salt is preferably from 0.01 to 0.5 mole, more preferably from 0.02 to 0.3 mole, still more preferably from 0.03 to 0.25 mole.

Methods and conditions for mixing photosensitive silver halide and an aliphatic acid silver salt, which are prepared separately, are not particularly limited so long as the effect of the present invention can be attained satisfactorily. Examples thereof include, for example, a method of mixing silver halide grains and an aliphatic acid silver salt after completion of respective preparations by using a high-speed stirring machine, ball mill, sand mill, colloid mill, vibrating mill or homogenizer or the like, or a method of preparing an aliphatic acid silver salt by mixing a photosensitive silver halide obtained separately at any time during the preparation of the aliphatic acid silver salt.

Methods and conditions for addition of a silver halide used for the present invention to a coating solution for image-forming layer are not particularly limited so long as the effect of the present invention can be obtained satisfactorily. Specific examples of the mixing method include a method in which a mixing is performed in a tank designed so as to obtain a desired average residence time which is calculated from addition flow rate and feeding amount to a coater, a method utilizing a static mixer described in N. Harnby, M. F. Edwards, A. W. Nienow, "Ekitai Kongo Gijutsu (Techniques for Mixing Liquids)", translated by Koji Takahashi, Chapter 8, Nikkan Kogyo Shinbunsha, 1989 and so forth.

Preferred examples of the reducing agent that can be used for the present invention include phenidone, hydroquinone, catechol and hindered phenol. Such reducing agents are described in U.S. Pat. Nos. 3,770,448, 3,773,512, 3,593,863 and 4,460,681, and Research Disclosure Nos. 17029 and 29963.

Examples of the reducing agent employable herein include aminohydroxycycloalkenone compounds (e.g., 2-hydroxy-piperidino-2-cyclohexenone), N-hydroxyurea derivatives (e.g., N-p-methylphenyl-N-hydroxyurea), aldehyde or ketone hydrazones (e.g., anthracenaldehydephenyl hydrazone), phosphor-amide phenols, phosphoramidanilines, polyhydroxybenzenes (e.g., hydroquinone, t-butyl-hydroquinone, isopropylhydroquinone, 2,5-dihydroxy-phenylmethylsulfone), sulfohydroxamic acids (e.g., benzenesulfohydroxamic acid), sulfonamidanilines (e.g., 4-(N-methanesulfonamide)aniline), 2-tetrazolylthiohydroquinones (e.g., 2-methyl-5-(1-phenyl-5-tetrazolylthio)hydroquinone), tetrahydroquinoxalines (e.g., 1,2,3,4-tetrahydroquinoxaline), amidoxins, combination of azines (e.g., aliphatic carboxylic acid aryl hydrazides) and ascorbic acid, combination of polyhydroxybenzene and hydroxylamine, reductone, hydrazine, hydroxamic acids, combination of azines and sulfonamidephenols, α-cyanophenylacetic acid derivative, combination of bis-β-naphthol and 1,3-dihydroxybenzene derivative, 5-pyrazolones, sulfonamidephenols, 2-phenylinedan-1,3-dion, chroman, 1,4-dihydroxypyridines (e.g., 2,6-dimethoxy-3,5-dicarbo-ethoxy-1,4-dihydropyridine), bisphenols (e.g., 2,2'-methylene-bis-(4-methyl-6-tert-butylphenol), bis(2-hydroxy-3-t-butyl-5-methylphenyl) methane, bis(6-hydroxy-m-tri)mesytol, 2,2-bis(4-hydroxy-3-methylphenyl)propane, 1,1-bis(2-hydroxy-3,5-dimethylphenyl)-3,5,5-trimethylhexane, 4,4-ethylidene-bis (2-t-butyl-6-methyl)phenol), ultraviolet-sensitive ascorbic acid derivatives, and 3-pyrazolidones. Esters of aminoreductones (e.g., piperidinohexose reductone monoacetate) that act as a precursor of reducing agent may be used as reducing agents. A particularly preferred example of reducing agents is bisphenol.

The amount of the reducing agent is preferably from 0.1 to 6 mmol/$m^2$, more preferably from 0.2 to 5.0 mmol/$m^2$.

An organic polyhalogenated compound represented by the general formula (1) is preferably used in the thermally processed image recording material of the present invention in order to prevent fog.

General formula (1)

$$Q-(Y)n-C(Z^1)(Z^2)(X)$$

In the formula (1), Q represents an alkyl group, aryl group or heterocyclic group, which may have a substituent, Y represents a divalent bridging group, n represents 0 or 1, $Z^1$ and $Z^2$ each independently represent a halogen atom, and X represents a hydrogen atom or an electron withdrawing group.

The alkyl group represented by Q in the formula (1) may be a liner, branched or cyclic alkyl group. The alkyl group has preferably 1–20 carbon atoms, more preferably 1–12 carbon atoms, particularly preferably 1–6 carbon atoms. Examples thereof include, for example, methyl, ethyl, allyl, n-propyl, iso-propyl, sec-butyl, iso-butyl, t-butyl, sec-pentyl, iso-pentyl, t-pentyl, t-octyl, 1-methylcyclohexyl and so forth. It is preferably a tertiary alkyl group.

The alkyl group represented by Q may have one or more substituents. The substituent may be any group so long as it does not adversely affect photographic performance. Examples thereof include, for example, a halogen atom (fluorine atom, chlorine atom, bromine atom or iodine atom), an alkyl group, an alkenyl group, an alkynyl group, an aryl group, a heterocyclic group (including N-substituted nitrogen-containing heterocyclic group such as morpholino group), an alkoxycarbonyl group, an aryloxycarbonyl group, a carbamoyl group, an imino group, an imino group substituted at the N atom, a thiocarbonyl group, a carbazoyl group, cyano group, a thiocarbamoyl group, an alkoxy group, an aryloxy group, a heterocyclyloxy group, an acyloxy group, an (alkoxy or aryloxy)carbonyloxy group, a sulfonyloxy group, an acylamino group, a sulfonamido group, a ureido group, a thioureido group, an imido group, an (alkoxy or aryloxy)carbonylamino group, a sulfamoylamino group, a semicarbazide group, a thiosemicarbazide group, an (alkyl or aryl)sulfonylureido group, a nitro group, an (alkyl or aryl)sulfonyl group, a sulfamoyl group, a group containing phosphoric acid amide or phosphoric acid ester structure, a silyl group, a carboxyl group or a salt thereof, a sulfo group or a salt thereof, phosphoric acid group, hydroxyl group, quaternary ammonium group and so forth. These substituents may further be substituted with similar substituents.

The aryl group represented by Q in the formula (1) may be monocyclic, or may have a condensed ring structure. The aryl group preferably has 6–20 carbon atoms, more preferably 6–16 carbon atoms, particularly preferably 6–10 carbon atoms, and phenyl group and naphthyl group are preferred.

The aryl group represented by Q may have one or more substituents. The substituent may be any group so long as it does not adversely affect photographic performance. Examples thereof include, for example, those mentioned as substituents for the aforementioned alkyl group.

The heterocyclic group represented by Q in the formula (1) is preferably a heterocyclic group of which heterocycle is 5- to 7-membered saturated or unsaturated monocycle or condensed cycles containing at least one of N, O and S atoms. Preferred examples of the heterocycle are pyridine, quinoline, isoquinoline, pyrimidine, pyrazine, pyridazine, phthalazine, triazine, furan, thiophene, pyrrole, oxazole, benzoxazole, thiazole, benzothiazole, imidazole, benzimidazole, thiadiazole, triazole and so forth, more preferred are pyridine, quinoline, pyrimidine, thiadiazole and benzothiazole, and particularly preferred are pyridine, quinoline and pyrimidine.

The heterocyclic group represented by Q may have one or more substituents. Examples of the substituent include, for example, those mentioned as substituents for the aforementioned alkyl group in the formula (1).

Q is preferably phenyl group, naphthyl group, quinolyl group, pyridyl group, pyrimidyl group, thiadiazolyl group or benzothiazolyl group, particularly preferably phenyl group, naphthyl group, quinolyl group, pyridyl group or pyrimidyl group.

As a substituent of Q, a ballast group for suppressing diffusion commonly used in photographic materials, a group adsorptive for the silver salt or a group imparting water-solubility may be introduced. The substituents may be polymerized to form a polymer, or bonded together to form a bis-type, tris-type or tetrakis-type compound.

In the formula (1), Y represents a divalent bridging group, preferably —$SO_2$—, —SO— or —CO—, particularly preferably —$SO_2$—.

In the formula (1), n represents 0 or 1, preferably 1.

$Z^1$ and $Z^2$ independently represent a halogen atom such as fluorine, chlorine, bromine and iodine. It is preferred that both of $Z^1$ and $Z^2$ represent bromine atom.

X represents a hydrogen atom or an electron withdrawing group. The electron withdrawing group used herein is a substituent having a Hammett's substituent group constant .p of a positive value, and specific examples thereof include cyano group, an alkoxycarbonyl group, an aryloxycarbonyl group, a carbamoyl group, a sulfamoyl group, an alkylsulfonyl group, an arylsulfonyl group, a halogen atom, an acyl group, a heterocyclic group and so forth. X is preferably a hydrogen atom or a halogen atom, and the most preferred is bromine atom.

Examples of the polyhalogenated compound of the formula (1) include, for example, those compounds disclosed in U.S. Pat. Nos. 3,874,946, 4,756,999, 5,340,712, 5,369,000, 5,464,737, JP-A-50-137126, JP-A-50-89020, JP-A-50-

119624, JP-A-59-57234, JP-A-7-2781, JP-A-7-5621, JP-A-9-160164, JP-A-10-197988, JP-A-9-244177, JP-A-9-244178, JP-A-9-160167, JP-A-9-319022, JP-A-9-258367, JP-A-9-265150, JP-A-9-319022, JP-A-10-197989, JP-A-11-242304, Japanese Patent Application Nos. 10-181459, 10-292864, 11-90095, 11-89773, 11-205330 and so forth.

The polyhalogenated compounds represented by the formula (1) may be used alone or in any combination of two or more of them. The amount thereof is preferably $1\times10^{-6}$ to $1\times10^{-2}$ mol/m$^2$, more preferably $1\times10^{-5}$ to $5\times10^{-3}$ mol/m$^2$ based on application amount per 1 m$^2$ of the thermally processed image recording material.

The compounds represented by the formula (1) of the present invention may be added to any layers on a support provided at the side of the image-forming layer, i.e., the image-forming layer or other layers provided on the same side. The compounds may preferably be added to the image-forming layer or a layer adjacent thereto.

The polyhalogenated compounds represented by the formula (1) can be used by dissolving said compounds in water or a suitable organic solvent, for example, alcohols such as methanol, ethanol, propanol and fluorinated alcohol, ketones such as acetone, methyl ethyl ketone and methyl isobutyl ketone, dimethylformamide, dimethyl sulfoxide, methyl cellosolve and so forth. The compounds may also be used as an emulsified dispersion mechanically prepared according to a known emulsification dispersion method by using an oil such as dibutyl phthalate, tricresyl phosphate, glyceryl triacetate or diethyl phthalate, ethyl acetate or cyclohexanone as an auxiliary solvent for dissolution. Alternatively, the compounds may be used after dispersion of a powder in water by using a ball mill, colloid mill, sand grinder mill, Manton galling, a microfluidizer, or by means of ultrasonic wave according to a known method for solid dispersion.

A compound having a phosphoryl group is preferably used for the thermally processed image recording material of the present invention, and phosphine oxides are particularly preferred. Specific examples thereof include triphenylphosphine oxide, tri-(4-methylphenyl)phosphine oxide, tri-(4-methoxyphenyl) phosphine oxide, tri-(t-butyl-phenyl) phosphine oxide, tri-(3-methylphenyl)phosphine oxide, trioctylphosphine oxide and so forth.

The compound having a phosphoryl group used for the present invention can be introduced into the thermally processed image recording material in the same manner as that for the reducing agent or the polyhalogenated compound.

In order to provide good images, the thermally processed image recording material of the present invention is required to provide a maximum image density of 3.0 or more, more preferably 3.3 or more, further preferably 3.5 or more, when it is measured as visual density that is conformed with the spectral sensitivity of human eyes.

The performance of the thermally processed image recording material of the present invention is improved if the layer containing an aliphatic acid silver salt is formed by applying a coating solution comprising 30% by weight or more of water as to the total solvent and drying it, and if the binder of the layer containing an aliphatic acid silver salt comprises a polymer latex soluble or dispersible in an aqueous solvent (water solvent) and showing an equilibrated moisture content of 2 weight % or less at 25° C. and relative humidity of 60%. In the most preferred embodiment, the polymer latex is prepared to have an ion conductivity of 2.5 mS/cm or less. As a method for preparing such polymer latex, there can be mentioned a method comprising synthesizing a polymer and purifying it by using a functional membrane for separation.

The aqueous solvent in which the polymer binder is soluble or dispersible is water or a mixed solvent of water and 70% by weight or less of a water-miscible organic solvent. Examples of the water-miscible organic solvent include, for example, alcohols such as methyl alcohol, ethyl alcohol and propyl alcohol; cellosolves such as methyl cellosolve, ethyl cellosolve and butyl cellosolve; ethyl acetate, dimethylformamide and so forth.

The terminology "aqueous solvent" referred to herein is also used for systems in which the polymer is not thermodynamically dissolved but is present in a so-called dispersed state.

The "equilibrated moisture content at 25° C. and relative humidity of 60%" referred to herein for polymer latex is represented by the following equation, in which W1 indicates the weight of a polymer in humidity-conditioned equilibrium at 25° C. and relative humidity of 60%, and W0 indicates the absolute dry weight of the polymer at 25° C.

Equilibrated moisture content at 25° C. and relative humidity of 60%

$$=[(W1-W0)/W0].100 \text{ (weight \%)}$$

For the details of the definition of moisture content and the method for measuring it, for example, there can be referred Lecture of Polymer Engineering, 14, Test Methods for Polymer Materials (Polymer Society of Japan, Chijin Shokan).

The equilibrated moisture content at 25° C. and relative humidity of 60% of the binder polymer used for the present invention is preferably 2% by weight or less, more preferably from 0.01 to 1.5% by weight, even more preferably from 0.02 to 1% by weight.

In the present invention, polymers dispersible in aqueous solvents are particularly preferred.

Examples of the dispersed state include, for example, that of a polymer latex in which fine solid particles of polymer are dispersed, that in which a polymer is dispersed in a molecular state or as micelles and so forth, and all of them are preferred.

In preferred embodiments of the invention, hydrophobic polymers such as acrylic resins, polyester resins, rubber resins (e.g., SBR resins), polyurethane resins, polyvinyl chloride resins, polyvinyl acetate resins, polyvinylidene chloride resins and polyolefin resins can preferably be used. The polymers may be linear, branched or crosslinked. They may be so-called homopolymers in which a single kind of monomer is polymerized, or copolymers in which two or more different kinds of monomers are polymerized. The copolymers may be random copolymers or block copolymers. The polymers may have a number average molecular weight of 5000 to 1000000, preferably from 10000 to 200000. Polymers having a too small molecular weight suffer from insufficient mechanical strength of the emulsion layer, and those having a too large molecular weight suffer from bad film forming property. Therefore, the both are not preferred.

The binder polymer used for the present invention preferably has Tg of −20° C. to 80° C., more preferably 0° C. to 70° C., further preferably 10° C. to 60° C., in view of film-forming property and image storability. Two or more kinds of polymers may be blended and used for the binder. In such a case, it is preferred that a weight average of Tg calculated according to the composition should be within the aforementioned ranges. When the polymer causes phase separation or has a core/shell structure, each phase or layer preferably has Tg within the aforementioned ranges.

The "aqueous solvent" mentioned above refers to a dispersion medium of which composition comprises at least 30% by weight of water. As for the dispersion condition, those in any condition may be used, including, for example, emulsion dispersion, micellar dispersion, molecular dispersion of a polymer having a hydrophilic moiety in the molecule and so forth. Among those, polymer latex is particularly preferred.

Specific examples of the preferred polymer latex are mentioned below. They are expressed with the constituent monomers. The numerals parenthesized indicate the contents in terms of % by weight. The molecular weights are number average molecular weights.

P-1: Latex of -MMA(70)-EA(27)-MAA(3)- (molecular weight: 37000)

P-2: Latex of -MMA(70)-2EHA(20)-St(5)-AA(5)- (molecular weight: 40000)

P-3: Latex of -St(50)-Bu(47)-MMA(3)- (molecular weight: 45000)

P-4: Latex of -St(68)-Bu(29)-AA(3)- (molecular weight: 60000)

P-5: Latex of -St(70)-Bu(27)-IA(3)- (molecular weight: 120000)

P-6: Latex of -St(75)-Bu(24)-AA(1)- (molecular weight: 108000)

P-7: Latex of -St(60)-Bu(35)-DVB(3)-MAA(2)- (molecular weight: 150000)

P-8:Latex of -St(70)-Bu(25)-DVB(2)-AA(3)- (molecular weight: 280000)

P-9: Latex of -VC(50)-MMA(20)-EA(20)-AN(5)-AA(5)- (molecular weight: 80000)

P-10: Latex of -VDC(85)-MMA(5)-EA(5)-MAA(5)- (molecular weight: 67000)

P-11: Latex of -Et(90)-MAA(10)- (molecular weight: 12000)

P-12: Latex of -St(70)-2EHA(27)-AA(3)- (molecular weight: 130000)

P-13: Latex of -MMA(63)-EA(35)-AA(2)- (molecular weight: 33000)

Abbreviations used for the constituent monomers are as follows:

MMA: methyl methacrylate
EA: ethyl acrylate
MAA: methacrylic acid
2EHA: 2-ethylhexyl acrylate
St: styrene
Bu: butadiene
AA: acrylic acid
DVB: divinylbenzene
VC: vinyl chloride
AN: acrylonitrile
VDC: vinylidene chloride
Et: ethylene
IA: itaconic acid The polymer latexes mentioned above are also commercially available, and those mentioned below can be used, for example. Examples of acrylic resins are CEBIAN A-4635, 46583, 4601 (all from Daicel Chemical Industries), Nipol Lx811, 814, 821, 820, 857 (all from Nippon Zeon) etc.; examples of polyester resins are FINETEX ES650, 611, 675, 850 (all from Dai-Nippon Ink & Chemicals), WD-size, WMS (both from Eastman Chemical) etc.; examples of polyurethane resins are HYDRAN AP10, 20, 30, 40 (all from Dai-Nippon Ink & Chemicals) etc.; examples of rubber resins are LACSTAR 7310K, 3307B, 4700H, 7132C (all from Dai-Nippon Ink & Chemicals), Nipol Lx416, 410, 438C, 2507 (all from Nippon Zeon) etc.; examples of polyvinyl chloride resins are G351, G576 (both from Nippon Zeon) etc.; examples of polyvinylidene chloride resins are L502, L513 (both from Asahi Chemical Industry) etc.; examples of polyolefin resins are CHEMIPEARL S120, SA100 (both from Mitsui Petrochemical) etc.

These polymer latexes may be used each alone, or two or more kinds of them may be blended as required.

As the polymer latex used in the present invention, styrene/butadiene copolymer latex is particularly preferred. In the styrene/butadiene copolymer, the weight ratio of styrene monomer units to butadiene monomer units is preferably 40/60 to 95/5. The ratio of the styrene monomer units and the butadiene monomer units preferably account for from 60 to 99% by weight of the copolymer. The preferred range of the molecular weight of the copolymer is similar to that mentioned above.

Examples of styrene/butadiene copolymer latexes preferably used for the present invention include the aforementioned P-3 to P-8, commercially available products, LACSTAR-3307B, 7132C, Nipol Lx416 and so forth.

The layer containing aliphatic acid silver salt of the thermally processed image recording material of the invention may optionally contain a hydrophilic polymer such as gelatin, polyvinyl alcohol, methyl cellulose and hydroxypropyl cellulose. The addition amount of the hydrophilic polymer is preferably 30% by weight or less, more preferably 20% by weight or less, of the total binder in the layer containing aliphatic acid silver salt.

The layer containing aliphatic acid silver salt (that is, the image-forming layer) of the thermally processed image recording material of the invention is preferably formed by using polymer latex. The amount of the binder in the layer containing aliphatic acid silver salt is such an amount that the weight ratio of total binder/aliphatic acid silver salt should be 1/10 to 10/1, more preferably 1/5 to 4/1.

The layer containing aliphatic acid silver salt usually also serves as a photosensitive layer (emulsion layer) containing a photosensitive silver salt, that is, a photosensitive silver halide. In such a case, the weight ratio of total binder/silver halide is preferably 5 to 400, more preferably 10 to 200.

The total amount of the binder in the image-forming layer is preferably 0.2 to 30 g/m$^2$, more preferably 1 to 15 g/m$^2$. The image-forming layer may optionally contain a crosslinking agent, a surfactant for improving coating property of the coating solution and so forth.

The solvent for the coating solution for the layer containing aliphatic acid silver salt of the thermally processed image recording material of the invention (for simplicity, solvents and dispersion media are collectively referred to as solvent) is an aqueous solvent containing at least 30% by weight of water. As for components other than water, any water-miscible organic solvents including, for example, methyl alcohol, ethyl alcohol, isopropyl alcohol, methyl cellosolve, ethyl cellosolve, dimethylformamide, ethyl acetate and so forth may be used. The water content of the solvent for the coating solution is preferably at least 50% by weight, more preferably at least 70% by weight. Preferred examples of the solvent composition are water, water/methyl alcohol=90/10, water/methyl alcohol=70/30, water/methyl alcohol/dimethylformamide=80/15/5, water/methyl alcohol/ethyl cellosolve=80/10/5, water/methyl alcohol/isopropyl alcohol=85/10/5 and so forth (numerals indicate weight %).

As antifoggants, stabilizers and stabilizer precursors that can be used for the present invention, there can be mentioned, for example, those mentioned in JP-A-10-62899, paragraph 0070 and EP 0803764A1, from page 20, line 57 to page 21, line 7. Antifoggants preferably used for the present invention are organic halides. Examples thereof include, for example, those disclosed in JP-A-11-65021, paragraphs 0111 to 0112. Particularly preferred are the compounds of formula (II) mentioned in JP-A-10-339934 (specific examples are tribromomethylnaphthylsulfone, tribromomethylphenylsulfone, tribromomethylpyridylsulfone, tribromomethyl(4-(2,4,6-trimethylsulfonyl)phenyl)sulfone, tribromomethyl(3-(butylcarbamoyl)phenyl)sulfone, etc.).

As the method for introducing an antifoggant into the thermally processed image recording material of the present invention, the aforementioned method for introducing the reducing agent can be mentioned. The organic polyhaogenated compound is also preferably added in the form of a solid microparticle dispersion.

Other examples of the antifoggant include the mercury(II) salts described in JP-A-11-65021, paragraph 0113 and the benzoic acids described in the same, paragraph 0114.

The thermally processed image recording material of the invention may contain an azolium salt as the antifoggant. Examples of the azolium salt include, for example, the compounds of the formula (XI) described in JP-A-59-193447, the compounds described in Japanese Patent Publication (Kokoku, hereinafter referred to as JP-B) 55-12581 and the compounds of the formula (II) described in JP-A-60-153039. The azolium salt may be present in any site of the thermally processed image recording material, but is preferably in a layer on the photosensitive layer side, more preferably in the layer containing aliphatic acid silver salt. The azolium salt may be added at any time during the preparation of the coating solution. When the azolium salt is added to the layer containing aliphatic acid silver salt, it may be added at any time during the period of from the preparation of the aliphatic acid silver salt to the preparation of the coating solution. The azolium salt is preferably added during the period after the preparation of the aliphatic acid silver salt and immediately before the coating. The azolium salt may be added in any form such as powder, solution and microparticle dispersion. It may also be added as a solution that also contains other additives such as sensitizing dye, reducing agent and toning agent. In the present invention, the amount of the azolium salt to be added is not particularly limited, but it is preferably $1 \cdot 10^{-6}$ mole to 2 moles, more preferably $1 \cdot 10^{-3}$ mole to 0.5 mole, per mole of silver.

The thermally processed image recording material of the invention may optionally contain any of mercapto compounds, disulfide compounds and thione compounds in order to control development by retarding or accelerating it, or enhance spectral sensitivity, or improve storage stability before and after development. Examples of those compounds include, for example, those described in JP-A-10-62899, paragraphs 0067 to 0069, those of the formula (I) mentioned in JP-A-10-186572 and those mentioned in the paragraphs 0033 to 0052 of the same as specific examples, and those described in EP 0803764A1, page 20, lines 36 to 56. Among these, preferred are mercapto-substituted heteroaromatic compounds.

In the present invention, it is preferable to add a toning agent. Examples of the toning agent are mentioned in JP-A-10-62899, paragraphs 0054 to 0055 and EP 0803764A1, page 21, lines 23 to 48. Preferred are phthalazinone, phthalazinone derivatives (e.g., 4-(1-naphthyl)phthalazinone, 6-chlorophthalazinone, 5,7-dimethoxyphthalazinone, 2,3-dihydro-1,4-phthalazinone and other derivatives) and metal salts thereof; combinations of phthalazinones and phthalic acid or derivatives thereof (e.g., phthalic acid, 4-methylphthalic acid, 4-nitrophthalic acid, tetrachlorophthalic anhydride etc.); phthalazines including phthalazine and phthalazine derivatives (e.g., 4-(1-naphthyl)phthalazine, 6-isopropylphthalazine, 6-t-butylphthalazine, 6-chlorophthalazine, 5,7-dimethoxyphthalazine, 2,3-dihydrophthalazine and other derivatives) and metal salts thereof; combinations of phthalazines and phthalic acid or derivatives thereof (e.g., phthalic acid, 4-methylphthalic acid, 4-nitrophthalic acid, tetrachlorophthalic anhydride etc.). Particularly preferred are combinations of phthalazines and phthalic acid derivatives.

Plasticizers and lubricants that can be used for the photosensitive layer of the thermally processed image recording material are described in JP-A-11-65021, paragraph 0117. Ultrahigh contrast agents for forming ultrahigh contrast images are described in the same publication, paragraph 0118, JP-A-11-223898, paragraphs 0136 to 0193, Japanese Patent Application No. 11-91652, general formula (H), formulas (1) to (3), formulas (A) and (B) and those mentioned in Japanese Patent Application No. 11-91652 as compounds of the general formulas (III) to (V) (specific compounds: Chem. 21 to Chem 24); and hardness enhancement promoters are described in JP-A-11-65021, paragraph 0102, and JP-A-11-223898, paragraphs 0194 to 0195. Addition methods and amounts of a nucleating agent are described in JP-A-11-223898, paragraphs 0182 to 0183.

When formic acid or a formic acid salt is used as a strongly fogging substance, it is preferably used on the side having the image-forming layer containing a photosensitive silver halide in an amount of 5 mmol or less, more preferably 1 mmol or less, per 1 mole of silver.

When a nucleating agent is used in the thermally processed image recording material the present invention, an acid formed by hydration of diphosphorus pentoxide or a salt thereof is preferably used together with the nucleating agent. Examples of the acid formed by hydration of diphosphorus pentoxide or a salt thereof include metaphosphoric acid (salt), pyrophosphoric acid (salt), orthophosphoric acid (salt), triphosphoric acid (salt), tetraphosphoric acid (salt), hexametaphosphoric acid (salt) and so forth. Particularly preferably used acids formed by hydration of diphosphorus pentoxide or salts thereof are orthophosphoric acid (salt) and hexametaphosphoric acid (salt). Specific examples of the salt are sodium orthophosphate, sodium dihydrogenorthophosphate, sodium hexametaphosphate, ammonium hexametaphosphate and so forth.

The acid formed by hydration of diphosphorus pentoxide or a salt thereof may be used in a desired amount (coating amount per 1 $m^2$ of the thermally processed image recording material) depending on the desired performance including sensitivity and fog. However, it can be used in an amount of preferably 0.1–500 $mg/m^2$, more preferably 0.5–100 $mg/m^2$.

The thermally processed image recording material of the present invention may be provided with a surface protective layer, for example, to prevent adhesion of the image-forming layer. The surface protective layer is described in, for example, JP-A-11-65021, paragraphs 0119 to 0120.

Gelatin is preferred as the binder in the surface protective layer, and polyvinyl alcohol (PVA) is also preferably used. Examples of PVA includes, for example, completely saponified PVA-105 [having a polyvinyl alcohol (PVA) content of at least 94.0% by weight, a degree of saponification of 98.5±0.5 mole %, a sodium acetate content of 1.5% by weight or less, a volatile content of 5.0% by weight or less, a viscosity (4% by weight at 20° C.) of 5.6±0.4 mPa·s]; partially saponified PVA-205 [having a PVA content of 94.0% by weight, a degree of saponification of 88.0±1.5 mole %, a sodium acetate content of 1.0% by weight, a volatile content of 5.0% by weight, a viscosity (4% by weight at 20° C.) of 5.0±0.4 mPa·s]; denatured polyvinyl alcohols, MP-102, MP-202, MP-203, R-1130, R2105 (all from Kraray Co., Ltd.) and so forth. The application amount of the polyvinyl alcohol (per $m^2$ of the support) for protective layers is preferably 0.3 to 4.0 $g/m^2$, more preferably 0.3 to 2.0 $g/m^2$ (per one layer).

As a binder for a surface protective layer, elastomeric block copolymers containing styrene (e.g., styrene/butadiene/styrene, styrene/isoprene/styrene), cellulose acetate, cellulose acetate butyrate, cellulose propionate and so forth can also be used.

When the thermally processed image recording material of the present invention is used for printing use is which dimensional change is critical, in particular, polymer latex is preferably used also in a protective layer or a back layer. Such latex is described in "Gosei Jushi Emulsion (Synthetic Resin Emulsion)", compiled by Taira Okuda and Hiroshi Inagaki, issued by Kobunshi Kanko Kai (1978); "Gosei Latex no Oyo (Application of Synthetic Latex)", compiled by Takaaki Sugimura, Yasuo Kataoka, Souichi Suzuki and Keishi Kasahara, issued by Kobunshi Kanko Kai (1993); Soichi Muroi, "Gosei Latex no Kagaku (Chemistry of Synthetic Latex)", Kobunshi Kanko Kai (1970) and so forth. Specific example thereof include latex of methyl methacrylate (33.5 weight %)/ethyl acrylate (50 weight %)/methacrylic acid (16.5 weight %) copolymer, latex of methyl methacrylate (47.5 weight %)/butadiene (47.5 weight %)/itaconic acid (5 weight %) copolymer, latex of ethyl acrylate/methacrylic acid copolymer, latex of methyl methacrylate (58.9 weight %)/2-ethylhexyl acrylate (25.4 weight %)/ethylene (8.6 weight %)/2-hydroxyethyl methacrylate (5.1 weight %)/acrylic acid (2.0 weight %) copolymer and so forth. As for the binder of the protective layer, there may be used the combination of polymer latex disclosed in Japanese Patent Application No. 11-6872, and techniques disclosed in Japanese Patent Application No. 11-143058, paragraphs 0021–0025, Japanese Patent Application No.11-6872, paragraphs 0027–0028, and Japanese Patent Application No. 11-19962 6, paragraphs 0023–0041.

The temperature for preparation of the coating solution for the image-forming layer used for the present invention may preferably be 30° C. to 65° C., more preferably 35° C. to 60° C., most preferably 35° C. to 55° C. The temperature of the coating solution immediately after the addition of the polymer latex may preferably be kept at 30° C. to 65° C. A reducing agent and an aliphatic acid silver salt may preferably be mixed before the addition of polymer latex.

The coating solution for the image-forming layer is preferably a so-called thixotropic flow. Thixotropy means that viscosity of a fluid lowers with increase of shear rate. Any apparatus may be used for measurement of viscosity, and for example, RFS Fluid Spectrometer from Rheometrics Far East Co., Ltd. is preferably used and the measurement is performed at 25° C. Viscosity of the coating solution for the image-forming layer is preferably 400 mPa·s to 100,000 mPa·s, more preferably 500 mPa·s to 20,000 mPa·s, at a shear rate of 0.1 $sec^{-1}$. The viscosity is preferably 1 mPa·s to 200 mPa·s, more preferably 5 mPa·s to 80 mPa·s, at a shear rate of 1000 $sec^{-1}$.

Various systems exhibiting thixotropic property are known and, for example, described in "Lecture on Rheology", Kobunshi Kanko Kai; Muroi & Morino, "Polymer Latex", Kobunshi Knako Kai and so forth. A fluid is required to contain a large amount of fine solid microparticles to exhibit thixotropic property. For enhancing thixotropic property, it is effective that the fluids is added with a viscosity-increasing linear polymer, or fine solid microparticles to be contained have anisotropic shapes and an increased aspect ratio. Use of an alkaline viscosity-increasing agent or a surfactant is also effective for that purpose.

The photothermographic emulsion used for the present invention is provided as one or more layers on the support. When it is provided as a monolayer, the layer must contain an aliphatic acid silver salt, silver halide, developing agent, binder and desired additional materials such as toning agent, coating aid and other auxiliary agents. When the layer is bilayer, the first emulsion layer (in general, the layer adjacent to the support) must contain an aliphatic acid silver salt and silver halide, and the second emulsion layer or said two layers may contain the other ingredients. Another type of bilayer structure is also employable in which one layer is a single emulsion layer containing all necessary ingredients and the other layer is a protective top coat layer. Multicolor photothermographic material may contain these two layers for each color, or may contain all necessary ingredients in a single layer as described in U.S. Pat. No. 4,708,928. As for multicolor photothermographic materials containing multiple dyes, each emulsion layers are kept individually by using a functional or non-functional barrier layer between the adjacent photosensitive layers as described in U.S. Pat. No. 4,460,681.

In the image-forming layer of the thermally processed image recording material of the present invention, various types of dyes and pigments may be used to improve tone, to prevent interference fringes generated during laser exposure, and to prevent irradiation. These techniques are detailed in International Patent Publication WO98/36322. Preferred dyes and pigments for the photothermographic material of the present invention include, for example, anthraquinone dyes, azomethine dyes, indoaniline dyes, azo dyes, indanthrone pigments of anthraquinone type (e.g., C.I. Pigment Blue 60 and so forth), phthalocyanine pigments (e.g., copper phthalocyanines such as C.I. Pigment Blue 15; metal-free phthalocyanines such as C.I. Pigment Blue 16), triarylcarbonyl pigments of printing lake pigment type, indigo, inorganic pigments (e.g., ultramarine, cobalt blue and so forth). Any methods are employed to add these dyes and pigments such as addition as a solution, an emulsion, or a dispersion of fine solid microparticles, or addition of a polymer mordant mordanted with these. The amount of these compounds to be used may vary depending on intended absorbance. In general, the compounds may preferably be used in an amount of 1 μg to 1 g per $m^2$ of the photothermographic material.

In the of the invention, an antihalation layer may be provided in a distant position from a light source relative to the photosensitive layer. The antihalation layer is described in JP-A-11-65021, paragraphs 0123 to 0124, JP-A-11-223898 etc.

In the thermally processed image recording material of the present invention, a decoloring dye and a base precursor are preferably added to a non-photosensitive layer of the photothermographic material so that the non-photosensitive layer can function as a filter layer or an antihalation layer. Photothermographic materials generally have non-photosensitive layers in addition to the photosensitive layers. Depending on their positions, the non-photosensitive layers are classified into (1) a protective layer to be provided on a photosensitive layer (the opposite side of the support); (2) an intermediate layer to be provided between two or more of photosensitive layers or between a photosensitive layer and a protective layer; (3) an undercoat layer to be provided between a photosensitive layer and a support; (4) a backing layer to be provided on a side opposite to the photosensitive layer. The filter layer is provided in the photosensitive material as the layer (1) or (2). The antihalation layer is provided in the photosensitive material as the layer (3) or (4).

The decoloring dye and the base precursor are preferably added to the same non-photosensitive layer. They may be also added separately to adjacent two non-photosensitive layers. If desired, a barrier layer may be provided between the two non-photosensitive layers.

As methods to add a decoloring dye to a non-photosensitive layer, a method may be employed which comprises step of adding a solution, an emulsion, a solid microparticles dispersion of the dye, or the dye impregnated in a polymer to a coating solution for the non-photosensitive layer. The dye may also be added to the non-photosensitive layer by using a polymer mordant. These methods for addition are the same as those generally employed for the addition of dyes to ordinary photothermographic materials. Polymer latexes used for preparation of the dye impregnated in a polymer are described in U.S. Pat. No. 4,199,363, German Patent Laid-open Nos. 25,141,274, 2,541,230, EP029104 and JP-B-53-41091. A method for emulsification by adding a dye to a solution in which a polymer is dissolved is described in International Patent Publication WO88/00723.

The amount of the decoloring dye may be determined depending on purpose of the use of the dye. In general, the dye is used in an amount to give an optical density (absorbance) of larger than 0.1 measured at an intended wavelength. The optical density is preferably 0.2 to 2. The amount of the dye to give such optical density may be generally from about 0.001 to about 1 $g/m^2$, particularly preferably from about 0.01 to about 0.2 $g/m^2$.

Decoloring of dyes in that manner can lower optical density of the material to 0.1 or less. Two or more different decoloring dyes may be used in the thermodecoloring type recording materials or photothermographic materials. Similarly, two or more different base precursors may be used in combination.

The thermally processed image recording material of the present invention is preferably a so-called single-sided photosensitive material comprising at least one photosensitive layer containing a silver halide emulsion on one side of support, and a backing layer on the other side.

The thermally processed image recording material of the present invention may preferably contain a matting agent for improving the transferability of the material. Matting agents are described in JP-A-11-65021, paragraphs 0126 to 0127. The matting agent is added in an amount of preferably 1 to 400 $mg/m^2$, more preferably 5 to 300 $mg/m^2$, as the amount per 1 $m^2$ of the photosensitive material.

The matting degree of the surface of the emulsion layer is not particularly limited so long as the material is free from stardust defects. Beck's smoothness of the matted surface is preferably 30 seconds to 2000 seconds, more preferably 40 seconds to 1500 seconds.

The matting degree of the backing layer in the present invention is preferably falls 10 seconds to 1200 seconds, more preferably 20 seconds to 800 seconds, most preferably 40 seconds to 500 seconds as shown by the Beck's smoothness.

In the present invention, the matting agent may preferably be contained in the outermost surface layer, or in a layer functioning as an outermost surface layer, or in a layer near to the outer surface of the photothermographic material. The agent may also be preferably contained in a layer functioning as a protective layer.

The back layers that are applicable to the photothermographic material of the present invention are described in JP-A-11-65021, paragraphs 0128 to 0130.

A hardening agent may be added to the photosensitive layer, the protective layer, the back layer, and other layers. Examples of the hardening agent are described in T. H. James, "THE THEORY OF THE PHOTOGRAPHIC PROCESS, FOURTH EDITION", Macmillan Publishing Co., Inc., 1977, pp. 77–87. Polyvalent metal ions described on page 78 of the above article, polyisocyanates described in U.S. Pat. No. 4,281,060 and JP-A-6-208193; epoxy compounds described in U.S. Pat. No. 4,791,042; vinylsulfone compounds described in JP-A-62-89048 and so forth may preferably be used.

The hardening agent is added to coating solutions as a solution. Preferred addition time of the solution to the coating solution of the protective layer resides in a period of from 180 minutes before the coating to just before the coating, preferably 60 minutes to 10 seconds before the coating. The method and conditions for mixing are not particularly limited so long as the effect of the present invention can be obtained satisfactorily. Specific examples of the mixing method include a method in which a mixing is performed in a tank designed so as to obtain a desired average residence time which is calculated from addition flow rate and feeding amount to a coater, a method utilizing a static mixer described in N. Harnby, M. F. Edwards, A. W. Nienow, "Ekitai Kongo Gijutsu (Techniques for Mixing Liquids)", translated by Koji Takahashi, Chapter 8, Nikkan Kogyo Shinbunsha, 1989 and so forth.

Surfactants that can be used in the present invention are described in JP-A-11-65021, paragraph 0132; usable solvents are described in the above patent document in paragraph 0133; usable supports are described in the above patent document in paragraph 0134; usable antistatic and electroconductive layers are described in the above patent document in paragraph 0135; and usable methods for forming color images are described in the above patent document in paragraph 0136.

Transparent supports for the thermally processed image recording material of the present invention may be colored with blue dyes (e.g., with Dye-1 described in Examples of JP-A-8-240877), or may be colorless. Techniques for undercoating the supports are described in JP-A-11-84574, JP-A-10-186565 and so forth. As for antistatic layers and undercoating, techniques disclosed in JP-A-56-143430, JP-A-56-143431, JP-A-58-62646, JP-A-56-120519 and so forth can also be used.

The thermally processed image recording material of the invention is preferably of a monosheet type. The monosheet type does not use any additional sheets such as image receiving materials, but can form images directly on the material itself.

The thermally processed image recording material of the present invention may further contain an antioxidant, a stabilizer, a plasticizer, a UV absorber or a coating aid. Such additives may be added to any of photosensitive layers or light insensitive layers. For these additives, International Patent Publication WO98/36322, EP803764A1, JP-A-10-186567, JP-A-10-18568 and so forth may be referred to.

The thermally processed image recording material of the present invention preferably has a film surface pH of 6.0 or less, more preferably 5.5 or less before heat development. While the lower limit is not particularly limited, it is normally around 3. For controlling the film surface pH, an organic acid such as phthalic acid derivatives or a nonvolatile acid such as sulfuric acid, and a volatile base such as ammonia are preferably used to lower the film surface pH. In particular, ammonia is preferred to achieve a low film surface pH, because it is highly volatile and therefore it can be removed before coating or heat development. A method for measuring the film surface pH is described in Japanese Patent Application No. 11-87297, paragraph 0123.

The thermally processed image recording material of the present invention can be produced by using any coating method. Specific examples thereof include various types of coating techniques, for example, extrusion coating, slide coating, curtain coating, dip coating, knife coating, flow coating, extrusion coating utilizing a hopper of the type described in U.S. Pat. No. 2,681,294 and so forth. Preferably used are extrusion coating and slide coating described in Stephen F. Kistler, Petert M. Schweizer, "LIQUID FILM COATING", published by CHAPMAN & HALL Co., Ltd., 1997, pp.399–536, and particularly preferably used is the slide coating. An example of the shape of a slide coater used for the slide coating is shown in FIG. 11*b,* 1, on page427 of the aforementioned reference. If desired, two or more layers may be formed at the same time, for example, according to the methods described from page 399 to page 536 of the aforementioned reference, or the methods described in U.S. Pat. No. 2,761,791 and British Patent No. 837,095.

Other techniques that can be used for the production of the photothermographic material of the present invention are also described in EP803764A1, EP883022A1, WO98/36322, JP-A-56-62648, JP-A-58-62744, JP-A-9-281637, JP-A-9-297367, JP-A-9-304869, JP-A-9-311405, JP-A-9-329865, JP-A-10-10669, JP-A-10-62899, JP-A-10-69023, JP-A-10-186568, JP-A-10-90823, JP-A-10-171063, JP-A-10-186565, JP-A-10-186567, JP-A-10-186569, JP-A-10-186570, JP-A-10-186571, JP-A-10-186572, JP-A-10-197974, JP-A-10-197982, JP-A-10-197983, JP-A-10-197985, JP-A-10-197986, JP-A-10-197987, JP-A-10-207001, JP-A-10-207004, JP-A-10-221807, JP-A-10-282601, JP-A-10-288823, JP-A-10-288824, JP-A-10-307365, JP-A-10-312038, JP-A-10-339934, JP-A-11-7100, JP-A-11-15105, JP-A-11-24200, JP-A-11-24201, JP-A-11-30832, JP-A-11-84574, JP-A-11-65021, JP-A-11-125880, JP-A-11-129629, JP-A-11-133536, JP-A-11-133537, JP-A-11-133538, JP-A-11-133539, JP-A-11-133542 and JP-A-11-133543.

The thermally processed image recording material of the invention may be developed in any manner. Usually, an imagewise exposed thermally processed image recording material is developed by heating. The temperature for the development is preferably 100° C. to 140° C., more preferably 110° C. to 140° C., particularly preferably 110° C. to 140° C. The development time is preferably 1 to 20 seconds, more preferably 2 to 18 seconds, even more preferably 3 to 15 seconds, particularly preferably 5 to 12 seconds.

For thermal development for the material, preferred is a plate heater system. For heat development by the plate heater system, the method described in JP-A-11-133572 is preferred. The plate heater system described in this references is a heat development apparatus wherein a thermally processed image recording material on which a latent image is formed is brought into contact with a heating means in a heat development section to obtain a visible image. In this apparatus, the heating means comprises a plate heater, and a plurality of presser rollers are disposed facing to one surface of the plate heater. Heat development of the thermally processed image recording material is attained by passing the material between the presser rollers and the plate heater. The plate heater is preferably sectioned into 2 to 6 stages, and the temperature of the top stage is preferably kept lower by 1 to 10° C. or so than that of the others. Such a method is also described in JP-A-54-30032. Such a plate heater system can remove moisture and organic solvent contained in the thermally processed image recording material out of the material, and prevent deformation of the support of the thermally processed image recording material by rapidly heating the material.

The thermally processed image recording material of the present invention can be exposed in any manner. As light source of exposure, laser rays are preferred. As the laser used in the present invention, gas lasers ($Ar^+$, He—Ne), YAG lasers, dye lasers, semiconductor lasers and so forth are preferred. A combination of semiconductor laser and second harmonic generating device may also be used. Preferred are gas or semiconductor lasers for red to infrared emission.

Single mode lasers can be used for the laser rays, and the technique disclosed in JP-A-11-65021, paragraph 0140 can be used.

The laser output is preferably at least 1 mW, more preferably at least 10 mW. Even more preferred is high output of at least 40 mW. If desired, a plurality of lasers may be combined. The diameter of one laser ray may be on the level of $1/e^2$ spot size of a Gaussian beam, falling between 30 and 200 $\mu$m or so.

As an example of a laser imager provided with a light exposure section and a heat development section, Fuji Medical Dry Laser Imager FM-DP L can be mentioned.

The thermally processed image recording material of the invention forms a monochromatic image based on silver image, and is preferably used as thermally processed image recording materials for use in medical diagnosis, industrial photography, printing and COM. In such applications, the monochromatic images formed can of course be duplicated on duplicating films, MI-Dup, from Fuji Photo Film for medical diagnosis; and for printing, the images can be used as the mask for forming reverse images on printing films such as DO-175 and PDO-100 from Fuji Photo Film, or on offset printing plates.

EXAMPLES

The present invention will be specifically explained with reference to the following examples. The materials, regents, ratios, procedures and so forth shown in the following examples can be optionally changed so long as such change does not depart from the spirit of the present invention. Therefore, the scope of the present invention is not limited to the following examples.

Example 1

<<Preparation of Aliphatic Acid Alkali Metal Salt Dispersion>>

<1> Preparation of aliphatic acid alkali metal salt solution 876 g of behenic acid (Edenor C22-85R, trade name, manufactured by Henkel Co.), 4230 ml of distilled water, 492 ml of a 5 N aqueous solution of NaOH, and 1200 ml of tert-butyl alcohol were mixed and allowed to react by stirring at 75° C. for one hour to obtain a solution of sodium behenate.

<2> Preparation of solution containing silver ions 2062 ml of an aqueous solution containing 404 g of silver nitrate (pH 4.0) was prepared and kept at 10° C.

<3> Preparation of solution in reaction bath

A reaction vessel containing 6350 ml of distilled water and 300 ml of tert-butyl alcohol was kept at 30° C.

Preparation of Aliphatic Acid Silver Salts A-F

With the addition times for the solution of the above <1> and <2> of 100 minutes and 97 minutes, respectively, addition of the solution of <2> was started 1 minute after the start of the addition of the solution of <1> to prepare grains. The reaction was performed at a temperature of 30° C. The addition methods and the dilution factors are shown in Table 1.

Preparation of Aliphatic Acid Silver Salts G-L

With the addition times for the solution of the above <1> and <2> of 100 minutes and 91 minutes, respectively, addition of the solution of <2> was started 7 minute after the start of the addition of the solution of <1> to prepare grains. The reaction was performed at a temperature of 30° C. The addition methods and the dilution factors are shown in Table 1.

The addition method indicated as "jar" addition in Table 1 means a method of adding the solutions of <1> and <2> onto a liquid surface in the reaction bath containing the liquid of <3>. The addition position of the sodium behenate solution and the addition position of the aqueous silver nitrate solution were arranged symmetrically with respect to the stirring axis as the center, and the positions are controlled at heights for not contacting with the reaction mixture. The dilution factor was adjusted by changing the addition flow rates of the solutions of <1> and <2> and the amount of the liquid of <3> as well as stirring rotation number in the reaction bath.

The addition method indicated as "closed" mixing indicated in Table 1 means that the mixing was performed in a closed vessel by using a small crystallization apparatus as shown in FIG. 1. In FIG. 1, the solution of <1> was measured in a tank 12, the solution of <2> in a tank 11, and the liquid of <3> in a tank 20, and they were circulated by a pump 17 at such flow rates that the dilution factor should become each of those indicated in Table 1. While the liquid contained in the closed mixer 18 shown in FIG. 1 was stirred at 10,000 rpm by a pipeline mixer, LR-I, manufactured by Mizuho Kogyo Co., Ltd., the solutions of <1> and <2> were added. As for temperature control, a heat exchanger 19 was used besides cooling of the tank 20. The temperature control was attained by supplying water at a suitable temperature to the heat exchanger and a jacket 21 of the tank 20 at a flow rate of 20 L/minute so that they could be maintained at 30° C. In this method, the dilution factor was adjusted by changing the addition flow rates of the solutions of <1> and <2> and the flow rate of the liquid circulated by the pump 17 (circulation flow rate).

In this example, the dilution factor was determined as follows. That is, the mixture was sufficiently stirred for 10 minutes after the addition, and then pAg and pH were measured to prepare a calibration curve. The pH measurement was performed at 25° C. by using a commercially available pH meter in this case. When the liquid to be measured showed high viscosity or it was difficult to measure the solid dispersion concentration etc., the liquid was filtered and pH of the filtrate was measured. Further, as for the measurement of pAg, pAg known in the art was measured at 25° C. Also in this case, when the liquid to be measured showed high viscosity or it was difficult to measure the solid dispersion concentration etc., the liquid was filtered and pAg of the filtrate was measured. Then, the liquid was added to an actual reaction system at an actual addition speed for 1 second, and pAg and pH distributions were determined after 1 second. This measurement was performed by disposing pH and pAg meters at various positions of the reaction bath. A dilution factor of a portion showing the least dilution degree was determined to be the dilution factor in this example.

TABLE 1

| Organic acid silver salt | Addition method | Dilution factor of solution containing silver ions | Dilution factor of aliphatic acid silver salt solution | Stirring rotation number in reaction bath (rpm) | Circulation flow rate (cc/min) |
|---|---|---|---|---|---|
| A | Jar | 15 | 5 | 300 | — |
| B | Jar | 59 | 20 | 1500 | — |
| C | Closed mixing | 15 | 5 | — | 330 |
| D | Closed mixing | 20 | 7 | — | 450 |
| E | Closed mixing | 40 | 13 | — | 730 |
| F | Closed mixing | 60 | 20 | — | 1200 |
| G | Jar | 15 | 5 | 280 | — |
| H | Jar | 59 | 20 | 1430 | — |
| I | Closed mixing | 15 | 5 | — | 325 |
| J | Closed mixing | 20 | 7 | — | 440 |
| K | Closed mixing | 40 | 13 | — | 720 |
| L | Closed mixing | 60 | 20 | — | 1200 |

The piping of the addition system for the aliphatic acid alkali metal salt solution was warmed by steam trace and the steam amount was controlled such that the liquid temperature at the outlet orifice of the addition nozzle should be 75. C. The piping of the addition system for the solution containing silver ions was maintained by circulating cold water outside a double pipe.

After finishing the addition of the aliphatic acid alkali metal salt solution or the solution containing silver ions, the mixture was left with stirring for 20 minutes at the same temperature and then the temperature was decreased to 25° C. Thereafter, the solid content was recovered by a centrifugal filtration and washed with water until electric conductivity of the filtrate became 30 $\mu$S/cm. The solid content obtained as described above was stored as a wet cake without being dried.

Then, a dispersion of an aliphatic acid silver salt (silver behenate) was prepared as follows. To the wet cake corresponding to 100 g of the dry solid content was added with 7.4 g of polyvinyl alcohol (PVA-217, trade name, average polymerization degree: about 1700) and water to make the total amount 3850 g, and the mixture was pre-dispersed by a homomixer. Then, the pre-dispersed stock dispersion was treated three times by using a dispersing machine (Microfluidizer-M-110S-EH; trade name, manufactured by Microfluidex International Corporation, using G10Z interaction chamber) with a pressure controlled to be 1750 kg/cm$^2$ to obtain a silver behenate dispersion. During the cooling operation, a desired dispersion temperature was achieved by providing coiled heat exchangers fixed before and after the interaction chamber and controlling the temperature of the refrigerant.

Volume weight mean diameters and their variation coefficients of the silver behenate grains contained in the silver behenate dispersions obtained as described above are shown in Table 2. The measurement of the grain size was carried out by using Master Sizer X manufactured by Malvern Instruments Ltd. Average ratios of the longer edge c and the shorter edge b and average grain thickness a evaluated by an electron microscope are shown in Table 2.

TABLE 2

| Grain | Volume weight mean diameter (μm) | Mean grain thickness a (μm) | Variation coefficient of volume weight mean diameter | Longer edge c/shorter edge b |
|---|---|---|---|---|
| A | 0.51 | 0.14 | 15 | 2.4 |
| B | 0.52 | 0.14 | 13 | 1.7 |
| C | 0.53 | 0.14 | 15 | 2.3 |
| D | 0.52 | 0.14 | 13 | 2.2 |
| E | 0.51 | 0.14 | 13 | 2.1 |
| F | 0.52 | 0.14 | 12 | 1.9 |
| G | 0.53 | 0.14 | 15 | 2.3 |
| H | 0.51 | 0.14 | 13 | 1.6 |
| I | 0.52 | 0.14 | 15 | 2.2 |
| J | 0.52 | 0.14 | 14 | 2.1 |
| K | 0.52 | 0.14 | 13 | 2.0 |
| L | 0.53 | 0.14 | 13 | 1.8 |

(Preparation of PET Support)

Using terephthalic acid and ethylene glycol, PET having an intrinsic viscosity IV of 0.66 (measured in phenol/tetrachloroethane=6/4 (weight ratio) at 25° C.) was obtained in a conventional manner. The PET was pelletized, and the pellets were dried at 130° C. for 4 hours, melted at 300° C., extruded from a T-die, and quenched to prepare an unstretched film having such a thickness that the film thickness after thermal fixation should become 175 μm.

The film was stretched along the longitudinal direction by 3.3 times using rollers having different peripheral speeds and then stretched along the transverse direction by 4.5 times using a tenter. In this case, the temperatures were 110° C. and 130° C., respectively. Thereafter, the film was subjected to thermal fixation at 240° C. for 20 seconds and relaxed by 4% along the transverse direction at the same temperature. Then, after chucks of the tenter were released, the both edges of the film were knurled, and the film was rolled up at 4 kg/cm$^2$ to provide a roll of the film having a thickness of 175 μm.

(Surface Corona Discharging Treatment)

Using a solid state corona discharging treatment machine Model 6KVA manufactured by Piller Inc., both surfaces of the support were treated at room temperature at 20 m/minute. In this case, from the read out values of the electric current and voltage, it was seen that the treatment of 0.375 kV●A●minute/m$^2$ was applied to the support. The treated frequency in this case was 9.6 kHz and the gap clearance between the electrode and the dielectric roll was 1.6 mm.

(Preparation of Undercoated Support)

(1) Preparation of Coating Solutions For Undercoat Layers

| Formulation 1 (for undercoat layer on photosensitive layer side) | |
|---|---|
| Pesresin A-515GB made by Takamatsu Yushi K.K. (30 weight % solution) | 234 g |
| Polyethylene glycol monononylphenyl ether (mean ethylene oxide number = 8.5, 10 weight % solution) | 21.5 g |
| MP-1000 made by Soken Kagaku K.K. (polymer microparticles, mean particle size: 0.4 m) | 0.91 g |
| Distilled water | 744 ml |

-continued

| Formulation 2 (for 1st layer on back surface) | |
|---|---|
| Butadiene-styrene copolymer latex (solid content: 40% by weight, weight ratio of butadiene/styrene = 32/68) | 158 g |
| 2,4-Dichloro-6-hydroxy-S-triazine sodium salt (8 weight % aqueous solution) | 20 g |
| 1 weight % Aqueous solution of sodium laurylbenzenesulfonate | 10 ml |
| Distilled water | 854 ml |
| Formulation 3 (for 2nd layer on back surface side) | |
| $SnO_2$/SbO (weight ratio: 9/1, mean particle size: 0.038 . m, 17 weight % dispersion) | 84 g |
| Gelatin (10% aqueous solution) | 89.2 g |
| Metorose TC-5 made by Shin-Etsu Chemical Co., Ltd. (2% aqueous solution) | 8.6 g |
| MP-1000 (polymer microparticles) made by Soken Kagaku K.K. | 0.01 g |
| 1 weight % Aqueous solution of sodium dodecylbenzenesulfonate | 10 ml |
| NaOH (1%) | 6 ml |
| Proxel (made by ICI Co.) | 1 ml |
| Distilled water | 805 ml |

(Preparation of Undercoated Support)

After applying the aforementioned corona discharging treatment to both surfaces of the aforementioned biaxially stretched polyethylene terephthalate support having a thickness of 175 μm, one surface (photosensitive layer side) thereof was coated with the undercoating solution of Formulation 1 by a wire bar in a wet coating amount of 6.6 ml/m$^2$ (per one surface) and dried at 180° C. for 5 minutes. Then, the back surface thereof was coated with the undercoating solution of Formulation 2 by a wire bar in a wet coating amount of 5.7 ml/m$^2$ and dried at 180° C. for 5 minutes. The back surface thus coated was further coated with the undercoating solution of Formulation 3 by a wire bar in a wet coating amount of 7.7 ml/m$^2$ and dried at 180° C. for 6 minutes to prepare an undercoated support.

(Preparation of Coating Solution For Back Surface)

(Preparation of Solid Microparticle Dispersion (a) of Base Precursor)

64 g of Base precursor compound 11, 28 g of diphenylsulfone and 10 g of a surface active agent, Demor N (manufactured by Kao Corporation), were mixed with 220 ml of distilled water, and the mixture was beads-dispersed using a sand mill (¼ Gallon Sand Grinder Mill, manufactured by Imex Co.) to obtain Solid microparticle dispersion (a) of the base precursor compound having a mean particle size of 0.2 μm.

(Preparation of Dye Solid Microparticle Dispersion)

9.6 g of Cyanine dye compound 13 and 5.8 g of sodium p-dodecylbenzenesulfonate were mixed with 305 ml of distilled water and the mixture was beads-dispersed using a sand mill (¼ Gallon Sand Grinder Mill, manufactured by Imex Co.) to obtain a dye solid microparticle dispersion having a mean particle size of 0.2 μm.

(Preparation of Coating Solution For Antihalation Layer)

17 g of gelatin, 9.6 g of polyacrylamide, 70 g of the aforementioned Solid microparticle dispersion (a) of the base precursor, 56 g of the aforementioned dye solid microparticle dispersion, 1.5 g of polymethyl methacrylate microparticles (mean particle size 6.5 μm), 0.03 g of benzoisothiazolinone, 2.2 g of sodium polyethylenesulfonate, 0.2 g of Blue dye compound 14 and 844 ml of water were mixed to prepare a coating solution for antihalation layer.

(Preparation of Coating Solution For Back Surface Protective Layer)

In a container kept at 40. C., 50 g of gelatin, 0.2 g of sodium polystyrenesulfonate, 2.4 g of N,N-ethylene-bis (vinyl-sulfonacetamide), 1 g of sodium t-octylphenoxyethoxyethanesulfonate, 30 mg of benzoisothiazolinone, 37 mg of N-perfluorooctylsulfonyl-N-propylalanine potassium salt, 0.15 g of polyethylene glycol mono(N-perfluorooctylsulfonyl-N-propyl-2-aminoethyl) ether [average polymerization degree of ethylene oxide: 15], 32 mg of $C_8F_{17}SO_3K$, 64 mg of $C_8F_{17}SO_2N(C_3H_7)(CH_2CH_2O)_4(CH_2)_4—SO_3Na$, 8.8 g of an acrylic acid/ethyl acrylate copolymer (copolymerization ratio (by weight): 5/95), 0.6 g of Aerosol OT (manufactured by American Cyanamid Company), 1.8 g (as liquid paraffin) of a liquid paraffin emulsion and 950 ml of water were mixed to form a coating solution for a back surface protective layer.

<<Preparation of Silver Halide Emulsion 1>>

1421 ml of distilled water was added with 3.1 ml of 1 weight % potassium bromide solution, and further added with 3.5 ml of 1 N nitric acid and 31.7 g of phthalized gelatin. Separately, Solution A was prepared by adding distilled water to 22.22 g of silver nitrate to dilute it to 95.4 ml, and Solution B was prepared by diluting 26.3 g of potassium bromide with distilled water to a volume of 161 ml. To the aforementioned mixture maintained at 34° C. and stirred in a titanium-coated stainless steel reaction vessel, the whole volume of Solution A and Solution B was added over 45 seconds at a constant flow rate while. Then, the mixture was added with 10 ml of 3.5 weight % aqueous hydrogen peroxide solution, and further added with 10.8 ml of a 10 weight % aqueous solution of benzimidazole. Separately, Solution C was prepared by adding distilled water to 51.86 g of silver nitrate to dilute it to 317.5 ml, and Solution D was prepared by diluting 45.8 g of potassium bromide with distilled water to a volume of 400 ml. The whole volume of Solution C was added to the mixture over 20 minutes at a constant flow rate. Solution D was added by the control double jet method while pAg was maintained at 8.1. Hexachloroiridic acid (III) potassium salt in an amount of $1\times10^{-4}$ mole per mole of silver was added at one time 10 minutes after the addition of Solutions C and D was started. Further, an aqueous solution of potassium iron(II) hexacyanide in an amount of $3\times10^{-4}$ mole per mole of silver was added at one time 5 seconds after the addition of Solution C was completed. Then, the mixture was adjusted to pH 3.8 using 1 N sulfuric acid, and the stirring was stopped. Then, the mixture was subjected to precipitation, desalting and washing with water, adjusted to pH 5.9 with 1 N sodium hydroxide to form a silver halide dispersion having pAg of 8.0.

The aforementioned silver halide dispersion was added with 5 ml of a 0.34 weight % methanol solution of 1,2-benzisothiazolin-3-one with stirring at 38° C., and after 40 minutes since then, added with a methanol solution of Spectral sensitizing dye A in an amount of $1.\ 10^{-3}$ mole per mole of silver. After 1 minutes, the mixture was warmed to 47. C., and 20 minutes after the warming, added with $7.6\ .\ 10^{-5}$ mole of sodium benzenethiosulfonate per mole of silver as a methanol solution. Further after 5 minutes, the mixture was added with Tellurium sensitizer B as a methanol solution in an amount of $1.9\ .\ 10^{-5}$ mole per mole of silver followed by ripening for 91 minutes. The mixture was added with 1.3 ml of a 0.8 weight % methanol solution of N,N'-dihydroxy-N"-diethylmelamine, and 4 minutes later, added with $3.7\ .\ 10^{-3}$ mole per mole of silver of 5-methyl-2-mercaptobenzimidazole and $4.9\ .\ 10^{-3}$ mole per mole of silver of 1-phenyl-2-heptyl-5-mercapto-1,3,4-triazole as a methanol solution to prepare Silver halide emulsion 1.

The grains in the prepared silver halide emulsion were pure silver bromide grains having a mean diameter as spheres of 0.046 $\mu$m and a variation coefficient of 20% for mean diameter as spheres. The grain size and others were obtained from averages for 1000 grains by using an electron microscope. The [100] face ratio of these grains was determined to be 80% by the Kubelka-Munk method.

<<Preparation of Silver Halide Emulsion 2>>

In the same manner as the preparation of Silver halide emulsion 1 except that the liquid temperature upon forming the grains was changed from 34° C. to 49° C., addition time of Solution C was changed to 30 minutes and potassium iron(II) hexacyanide was not used, Silver halide emulsion 2 was prepared. Further, as in the case of Silver halide emulsion 1, the steps of precipitation, desalting, washing with water and dispersion were performed. Furthermore, in the same manner as in the case of Silver halide emulsion 1 except that the addition amount of Spectral sensitizing dye A was changed to $7.5\times10^{-3}$ mole per mole of silver and the addition amount of 1-phenyl-2-heptyl-5-mercapto-1,3,4-triazole was changed to $3.3\times10^{-3}$ mole of per mole of silver, spectral sensitization, chemical sensitization, and addition of 5-methyl-2-mercaptobenz-imidazole and 1-phenyl-2-heptyl-5-mercapto-1,3,4-traizole were performed to obtain Silver halide emulsion 2. Emulsion grains of Silver halide emulsion 2 were pure silver bromide cubic grains having a mean grain size of 0.080 $\mu$m as spheres and a variation coefficient of 20% for diameter as spheres.

<<Preparation of Silver Halide Emulsion 3>>

In the same manner as the preparation of Silver halide emulsion 1 except that the liquid temperature upon forming the grains was changed from 34° C. to 27° C., Silver halide emulsion 3 was prepared. Further, as in the case of Silver halide emulsion 1, the steps of precipitation, desalting, washing with water and dispersion were performed. Furthermore, in the same manner as in the case of Silver halide emulsion 1 except that the addition amount of Spectral sensitizing dye A solid dispersion (gelatin aqueous solution) was changed to $6\times10^{-3}$ mole per mole of silver and the addition amount of Tellurium sensitizer B was changed to $5.2\times10^{-4}$ mole per mole of silver, Silver halide emulsion 3 was obtained. Emulsion grains of Silver halide emulsion 3 were pure silver bromide cubic grains having a mean grain size of 0.038 $\mu$m as spheres and a variation coefficient of 20% for diameter as spheres.

<<Preparation of Mixed Emulsion A For Coating Solution>>

70% by weight of Silver halide emulsion 1, 15% by weight of Silver halide emulsion 2 and 15% by weight of Silver halide emulsion 3 were mixed and added with benzothiazolium iodide in an amount of $7\ .\ 10^{-3}$ mole per mole of silver as a 1 weight % aqueous solution to form Mixed emulsion A for coating solution.

<<Preparation of Solid Microparticle Dispersion of Reducing Agent>>

10 kg of Compound A and 10 kg of a 20 weight % aqueous solution of denatured polyvinyl alcohol (Poval MP203, manufactured by Kuraray Co., Ltd.) were added with 16 kg of water, and mixed sufficiently to form slurry. The slurry was fed by a diaphragm pump to a sand mill of horizontal type (UVM-2, manufactured by Imex Co.) containing zirconia beads having a mean diameter of 0.5 mm, and dispersed for 3 hours and 30 minutes. Then, the slurry was added with 0.2 g of benzothiazolinone sodium salt and water so that the concentration of the reducing agent could become 25 weight % to obtain a solid microparticule dispersion of reducing agent. The reducing agent particles contained in the dispersion obtained as described above had a median diameter of 0.42 $\mu$m and the maximum particle size of 2.0 μm or less. The obtained reducing agent dispersion was filtered through a polypropylene filter having a pore size of 10.0 μm to remove dusts and so forth, and stored.

<<Preparation of 10 Weight % Dispersion of Mercapto Compound>>

5 kg of 1-phenyl-2-heptyl-5-mercapto-1,3,4-triazole and 5 kg of a 20 weight % aqueous solution of denatured polyvinyl alcohol (Poval MP203, manufactured by Kuraray Co., Ltd.) were added with 8.3 kg of water, and mixed sufficiently to form slurry. The slurry was fed by a diaphragm pump to a sand mill of horizontal type (UVM-2, manufactured by Imex Co.) containing zirconia beads having a mean diameter of 0.5 mm, and dispersed for 6 hours. Then, the slurry was added with water so that the concentration of the mercapto compound could become 10 weight % to obtain a mercapto compound dispersion. The mercapto compound particles contained in the mercapto compound dispersion obtained as described above had a median diameter of 0.40 μm and the maximum particle size of 2.0 μm or less. The mercapto compound dispersion was filtered through a polypropylene filter having a pore size of 10.0 μm to remove dusts and so forth, and stored. The dispersion was filtered through a polypropylene filter having a pore size of 10.0 μm immediately before use.

<<Preparation of 20 Weight % Dispersion of Organic Polyhalogenated Compound 1>>

5 kg of tribromomethylnaphthylsulfone, 2.5 kg of a 20 weight % aqueous solution of denatured polyvinyl alcohol (Poval MP203, manufactured by Kuraray Co., Ltd.) and 213 g of 20 weight % aqueous solution of sodium triisopropylnaphthalenesulfonate were added with 10 kg of water, and mixed sufficiently to form slurry. The slurry was fed by a diaphragm pump to a sand mill of horizontal type (UVM-2, manufactured by Imex Co.) containing zirconia beads having a mean diameter of 0.5 mm, and dispersed for 5 hours. Then, the slurry was added with 0.2 g of benzisothiazolinone sodium salt and water so that the concentration of the organic polyhalogenated compound could become 20 weight % to obtain an organic polyhalogenated compound dispersion. The organic polyhalogenated compound particles contained in the polyhalogenated compound dispersion obtained as described above had a median diameter of 0.36 μm and the maximum particle size of 2.0 μm or less. The obtained organic polyhalogenated compound dispersion was filtered through a polypropylene filter having a pore size of 3.0 μm to remove dusts and so forth, and stored.

<Preparation of 25 Weight % Dispersion of Organic Polyhalogenated Compound 2>>

A dispersion was prepared in the same manner as the preparation of the 20 weight % dispersion of organic polyhalogenated compound 1 except that 5 kg of tribromomethyl (-3-(n-butylcarbamoyl)phenyl)sulfone was used instead of 5 kg of tribromomethylnaphthylsulfone, diluted so that the concentration of the organic polyhalogenated compound could become 25 weight %, and filtered. The organic polyhalogenated compound particles contained in the organic polyhalogenated compound dispersion obtained as described above had a median diameter of 0.38 μm and the maximum particle size of 2.0 μm or less. The obtained organic polyhalogenated compound dispersion was filtered through a polypropylene filter having a pore size of 3.0 μm to remove dusts and so forth, and stored.

<<Preparation of 30 Weight % Dispersion of Organic Polyhalogenated Compound 3>>

A dispersion was prepared in the same manner as the preparation of the 20 weight % dispersion of organic polyhalogenated compound 1 except that 5 kg of tribromomethylphenylsulfone was used instead of 5 kg of tribromomethylnaphthylsulfone and the amount of the 20 weight % aqueous solution of MP203 was changed to 5 kg, diluted so that the concentration of the organic polyhalogenated compound could become 30 weight %, and filtered. The organic polyhalogenated compound particles contained in the organic polyhalogenated compound dispersion obtained as described above had a median diameter of 0.41 μm and the maximum particle size of 2.0 μm or less. The obtained organic polyhalogenated compound dispersion was filtered through a polypropylene filter having a pore size of 3.0 μm to remove dusts and so forth, and stored. The dispersion was stored at 10° C. or less until use.

<<Preparation of 25 Weight % Dispersion of Phosphine Oxide Compound>>

10 kg of triphenylphosphine oxide and 10 kg of a 20 weight % aqueous solution of denatured polyvinyl alcohol (Poval MP203, manufactured by Kuraray Co., Ltd.) were added with 16 kg of water, and mixed sufficiently to form slurry. The slurry was fed by a diaphragm pump to a sand mill of horizontal type (UVM-2, manufactured by Imex Co.) containing zirconia beads having a mean diameter of 0.5 mm, and dispersed for 3 hours and 30 minutes. Then, the slurry was added with 0.2 g of benzothiazolinone sodium salt and water so that the concentration of the reducing agent could become 25% by weight to obtain a solid microparticle dispersion of phosphine oxide. The particles contained in the phosphine oxide dispersion obtained as described above had a median diameter of 0.48 μm and the maximum particle size of 2.0 μm or less. The obtained reducing agent dispersion was filtered through a polypropylene filter having a pore size of 10.0 μm to remove dusts and so forth, and stored.

<<Preparation of 5 Weight % Solution of Phthalazine Compound>>

8 kg of denatured polyvinyl alcohol (Poval MP-203, manufactured by Kuraray Co., Ltd.) was dissolved in 174.57 kg of water and then added with 3.15 kg of 20 weight % aqueous solution of sodium triisopropylnaphthalenesulfonate and 14.28 kg of 70 weight % aqueous solution of 6-isopropylphthalazine to obtain a 5 weight % solution of 6-isopropylphthalazine.

<<Preparation of 20 Weight % Dispersion of Pigment>>

64 g of C.I. Pigment Blue 60 and 6.4 g of Demor N manufactured by Kao Corporation were added with 250 g of water and mixed sufficiently to provide slurry. Then, 800 g of zirconia beads having a mean diameter of 0.5 mm were placed in a vessel together with the slurry and the slurry was dispersed by a dispersing machine (¼ G Sand Grinder Mill; manufactured by Imex Co.) for 25 hours to obtain a pigment dispersion. The pigment particles contained in the pigment dispersion obtained as described above had a mean particle size of 0.21 μm.

<<Preparation of 40 Weight % SBR Latex>>

SBR latex purified by ultrafiltration (UF) was obtained as follows.

The SBR latex mentioned below diluted by 10 times with distilled water was diluted and purified by using an UF-purification module FS03-FC-FUYO3A1 (manufactured by Daisen Membrane System K.K.) until the ion conductivity became 1.5 mS/cm, and added with Sandet-BL (manufactured by SANYO CHEMICAL INDUSTRIES, LTD.) to a concentration of 0.22% by weight. Further, the latex was added with NaOH and $NH_4OH$ so that the ratio of $Na^+$ ion:$NH_4^+$ ion could become 1:2.3 (molar ratio) to adjust pH to 8.4. At this point, the concentration of the latex was 40% by weight.

(SBR latex: a latex of -St(68)-Bu(29)-AA(3)-, wherein the numerals in the parentheses indicate the contents in terms of % by weight, St represents styrene, Bu represents butadiene and AA represents acrylic acid)

The latex had the following characteristics: mean particle size of 0.1 μm, concentration of 45%, equilibrated moisture content of 0.6% by weight at 25° C. and relative humidity 60%, and ion conductivity of 4.2 mS/cm (measured for the latex stock solution (40%) at 25° C. by using a conductometer, CM-30S, manufactured by Toa Electronics, Ltd.), pH 8.2.

<<Preparation of Coating Solution For Emulsion Layer (Photosensitive Layer)>>

1.1 g of the 20 weight % aqueous dispersion of the pigment obtained above, 103 g of an aliphatic acid silver salt dispersion comprising one of Grains A to L, 5 g of the 20 weight % aqueous solution of polyvinyl alcohol, PVA-205 (manufactured by Kuraray Co., Ltd.), 25 g of the 25 weight % dispersion of the reducing agent, 16.2 g in total of the dispersions of organic polyhalogenated compounds 1 to 3 (weight ratio=1:8:1), 21 g of the 25 weight % dispersion of phosphine oxide compound, 6.2 g of the 10 weight % dispersion of mercapto compound, 106 g of the 40 weight % SBR latex purified by ultrafiltration (UF) and undergone pH adjustment, and 18 ml of the 5 weight % solution of the phthalazine compound were combined, added with 10 g of Silver halide mixed emulsion A, and mixed sufficiently to prepare a coating solution for emulsion layer. The coating solution was fed as it was to a coating die in such a feeding amount giving a coating amount of 70 ml/m$^2$ and coated.

The viscosity of the coating solution for emulsion layer described above was measured by a B-type viscometer manufactured by Tokyo Keiki K.K. and found to be 85 [mPa·s] at 40. C. (Rotor No. 1, 60 rpm).

The viscosity of the coating solution was measured at 25° C. by an RFS fluid spectrometer produced by Rheometric Far East Co., Ltd., and found to be 1500, 220, 70, 40 and 20 [mPa·s] at shear rates of 0.1, 1, 10, 100 and 1000 [1/second], respectively.

<<Preparation of Coating Solution For Intermediate Layer on the Emulsion Layer Surface>>

772 g of an aqueous solution of 10% by weight polyvinyl alcohol, PVA-205 (manufactured by Kuraray Co., Ltd.), 5.3 g of the 20 weight % dispersion of the pigment, and 226 g of a 27.5 weight % latex of methyl methacrylate/styrene/butyl acrylate/hydroxyethyl methacrylate/acrylic acid copolymer (copolymerization ratio (by weight): 64/9/20/5/2) were added with 2 ml of a 5 weight % aqueous solution of Aerosol OT (manufactured by American Cyanamid Company), 10.5 ml of a 20 weight % aqueous solution of phthalic acid diammonium salt and water in such an amount giving a total amount of 880 g to form a coating solution for intermediate layer. This coating solution was fed to a coating die in such an amount that gave a coating amount of 10 ml/m$^2$.

The viscosity of the coating solution measured by a B-type viscometer at 40. C. (Rotor No. 1, 60 rpm) was 21 [mPa·s].

<<Preparation of Coating Solution for 1st Protective Layer on Emulsion Layer Surface>>

64 g of inert gelatin was dissolved in water, added with 80 g of a 27.5 weight % latex solution of methyl methacrylate/styrene/butyl acrylate/hydroxyethyl methacrylate/acrylic acid copolymer (copolymerization ratio (by weight): 64/9/20/5/2), 23 ml of a 10 weight % methanol solution of phthalic acid, 23 ml of a 10 weight % aqueous solution of 4-methylphthalic acid, 28 ml of 1 N sulfuric acid, 5 ml of a 5 weight % aqueous solution of Aerosol OT (manufactured by American Cyanamid Company), 0.5 g of phenoxyethanol, 0.1 g of benzoisothiazolinone, and water in such an amount that gave a total amount of 750 g to form a coating solution. The coating solution was mixed with 26 ml of 4 weight % chromium alum by a static mixer immediately before coating, and fed to a coating die in such an amount that gave a coating amount of 18.6 ml/m$^2$.

The viscosity of the coating solution measured by a B-type viscometer (Rotor No. 1, 60 rpm) at 40. C. was 17 [mPa·s].

<<Preparation of Coating Solution For 2nd Protective Layer on Emulsion Layer Surface>>

80 g of inert gelatin was dissolved in water, added with 102 g of a 27.5 weight % latex solution of methyl methacrylate/styrene/butyl acrylate/hydroxyethyl methacrylate/acrylic acid copolymer (copolymerization ratio (by weight): 64/9/20/5/2), 3.2 ml of a 5 weight % solution of N-perfluorooctylsulfonyl-N-propylalanine potassium salt, 32 ml of a 2 weight % aqueous solution of polyethylene glycol mono(N-perfluorooctylsulfonyl-N-propyl-2-aminoethyl) ether [average polymerization degree of ethylene oxide=15], 23 ml of a 5 weight % aqueous solution of Aerosol OT (manufactured by American Cyanamid Company), 4 g of polymethyl methacrylate microparticles (mean particle size: 0.7. m), 21 g of polymethyl methacrylate microparticles (mean particle size: 6.4 .m), 1.6 g of 4-methylphthalic acid, 4.8 g of phthalic acid, 44 ml of 1 N sulfuric acid, 10 mg of benzoisothiazolinone and water in such an amount that gave a total amount of 650 g. The mixture was further mixed with 445 ml of an aqueous solution containing 4 weight % chromium alum and 0.67 weight % of phthalic acid by a static mixer immediately before coating to form a coating solution for surface protective layer, which was fed to a coating die in such an amount that gave a coating amount of 8.3 ml/m$^2$.

The viscosity of the coating solution measured by a B-type viscometer (Rotor No. 1, 60 rpm) at 40° C. was 9 [mPa·s].

<<Preparation of Thermally Processed Image Recording Material>>

On the back side of the aforementioned support having an undercoat layer, the coating solution for antihalation layer and the coating solution for back surface protective layer were simultaneously applied as stacked layers so that the applied solid content amount of the solid microparticle dye in the antihalation layer could be 0.04 g/m$^2$, and the applied amount of gelatin in the protective layer should be 1.7 g/m$^2$, and dried to form an antihalation back layer.

Then, on the side opposite to the back side, an image-forming layer (coated silver amount of the silver halide was 0.14 g/m$^2$), intermediate layer, first protective layer, and second protective layer were simultaneously applied in this order from the undercoat layer by the slide bead application method as stacked layers to form a sample of thermally processed image recording material.

The coating was performed at a speed of 160 m/min. The gap between the tip of coating die and the support was set to be 0.14 to 0.28 mm, and the coated width was controlled so that it could spread by 0.5 mm each at both sides compared with the projecting slit width of the coating solution. The pressure in the reduced pressure chamber was adjusted to be lower than the atmospheric pressure by 392 Pa. In this case, handling, temperature and humidity were controlled so that the support would not be electrostatically charged, and electrostatic charge was further eliminated by ionized wind immediately before the coating. In the subsequent chilling zone, the material was blown with air showing a dry-bulb temperature of 18° C. and a wet-bulb temperature of 12° C. for 30 seconds to cool the coating solutions. Then, in the floating type drying zone in a coiled shape, the material was blown with drying air showing a dry-bulb temperature of 30° C. and a wet-bulb temperature of 18° C. for 200 seconds. Subsequently, the material was passed through a drying zone of 70° C. for 20 seconds, and then another drying zone of 90° C. for 10 seconds, and cooled to 25° C. to evaporate the solvent in the coating solution. The average wind velocities of the wind applied to the coated layer surface in the chilling zone and the drying zones were 7 m/sec.

The prepared photothermographic material showed matting degrees of 55 seconds for the image-forming layer side, and 130 seconds for the back surface, in terms of Beck's smoothness.

Spectral sensitizing dye A

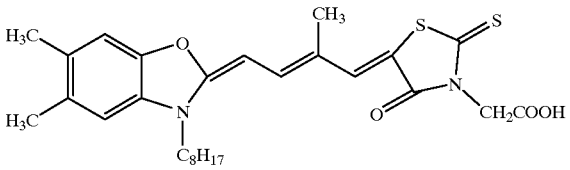

Tellurium sensitizer B

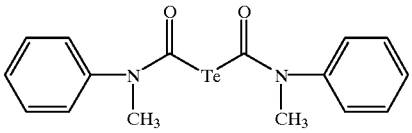

Base precursor compound 11

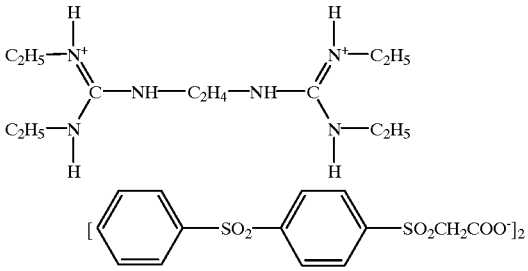

Cyanine dye compound 13

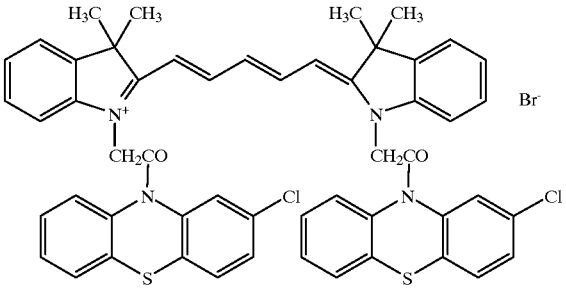

-continued

Blue dye compound 14

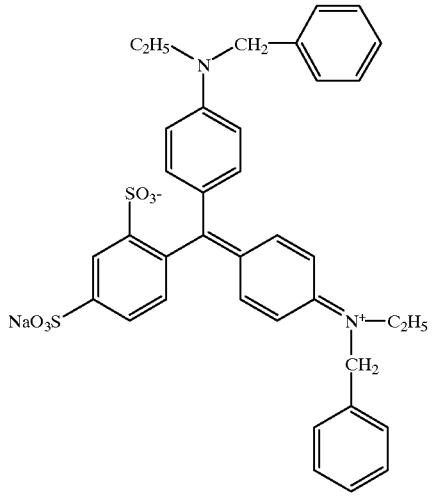

Compound A

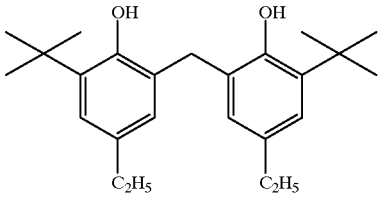

(Evaluation of Photographic Performance)

Each of Samples A to L prepared as described above was light-exposed and heat-developed (about 120° C.) by using Fuji Medical Dry Laser Imager FM-DP L (provided with a semiconductor laser of 660 nm, maximum output: 60 mW (IIIB)) ,and optical density of an unexposed portion of the obtained image was measured by using a densitometer. The optical density was represented with a relative value based on the density of Sample E, which was taken as 100. The results are shown in Table 3 as Dmin.

Further, each sample was left under a condition of 50° C. and 75% relative humidity for 3 days, and then light-exposed and heat-developed in the same manner. The optical density of an unexposed portion of the obtained image was measured. Variation ratios (percentage) of the optical density relative to that of each corresponding sample not left under the above condition are also shown in Table 3 as Dmin variation ratio.

TABLE 3

| Sample | Grain used | Dmin | Dmin variation ratio |
|---|---|---|---|
| A | A | 185 | 42 |
| B | B | 102 | 0 |
| C | C | 135 | 22 |
| D | D | 107 | 1 |
| E | E | 100 | 0 |
| F | F | 96 | 0 |
| G | G | 175 | 31 |
| H | H | 100 | 0 |
| I | I | 145 | 24 |
| J | J | 109 | 2 |
| K | K | 102 | 0 |
| L | L | 97 | 0 |

It can be understood that the samples according to the present invention showed lower Dmin and smaller Dmin variation ratios compared with the comparative samples.

Example 2

<<Preparation of Silver halide grain>>

In 700 ml of water, 22 g of phthalized gelatin and 30 mg of potassium bromide were dissolved, and after adjusting the pH to 5.0 at a temperature of 35° C., 159 ml of an aqueous solution containing 18.6 g of silver nitrate and an aqueous solution containing potassium bromide and potassium iodide at a molar ratio of 92:8 were added by the control double jet method over 10 minutes while pAg was maintained at 7.7. Subsequently, 476 ml of an aqueous solution containing 55.4 g of silver nitrate and an aqueous solution containing 6 μmol/L of dipotassium hexachloroiridate and 1 mol/L of potassium bromide were added by the control double jet method over 30 minutes while pAg was maintained at 7.7. Then, pH of the mixture was lowered to cause coagulation precipitation to effect desalting, and the mixture was added with 0.1 g of phenoxyethanol and adjusted to pH 5.9 and pAg of 8.2 to complete the preparation of silver iodobromide grains (cubic grains having a core iodine content of 8 mol %, an average iodine content of 2 mol %, an average grain size of 0.05 μm, a variation coefficient of the projected area of 8%, and a [100] face ratio of 92%).

The silver halide grains obtained above was warmed to 60. C., added with 85 μM of sodium thiosulfate, 11 μM of 2,3,4,5,6-pentafluorophenyldiphenylphosphine selenide, 2 μM of Tellurium compound 1-a, 3.32 μM of chloroauric acid and 230 μM of thiocyanic acid per mole of silver, ripened for 120 minutes, and then quenched to 30° C. to obtain Silver halide emulsion B.

<<Preparation of Aliphatic Acid Silver Salt Emulsion>>

Aliphatic acid silver salt grains were formed under the exactly same reaction condition as shown in Example 1, Table 1. Then, the solid content was separated by centrifugal filtration, and washed with water until the conductivity of the filtrate became 30 μS/cm. The solid content obtained as described above was added with 37 g of a 1.2 weight % solution of polyvinyl acetate in butyl acetate, and stirred. Then, the stirring was stopped to allow separation into an oil layer and an aqueous layer. The aqueous layer was removed together with the contained salts to obtain the oil layer. The oil layer was added with 20 g of a 2.5 weight % solution of polyvinyl butyral (Denka Butyral #3000-K, DENKI KAGAKU KOGYO K.K.) in 2-butanone and stirred. The oil layer was further added with 0.1 mmol of pyridinium bromide perbromide and 0.13 mmol of potassium bromide dihydrate together with 0.7 g of methanol, and then with 40 g of 2-butanone and 7.8 g of polyvinyl butyral (PVB B-76, Monsanto), and dispersed by a homogenizer to obtain 12 kinds of dispersions. Then, Silver halide emulsion B in an amount of 0.15 mole per 1 mole of aliphatic acid silver salt was added to each dispersion and dispersed by a homogenizer.

<<Preparation of Coating Solution For Emulsion Layer>>

The aliphatic acid silver salt emulsion obtained above was added with the following reagents in the indicated amounts per 1 mole of silver. At 25° C., the emulsion was added with 10 mg of sodium phenylthiosulfonate, 85 mg of Dye 1-b, 30 mg of Dye 1-c and 2 g of 2-tribromomethylsulfonylpyridine, further added with 21.5 g of 4-chlorobenzophenone-2-carboxylic acid, 580 g of 2-butanone and 220 g of dimethylformamide with stirring, and left for 3 hours. Then, 8 g of 5-tribromomethylsulfonyl-2-methylthiadiazole, 6 g of 2-tribromomethylsulfonylbenzothiazole,3 g of 4,6-di-trichloromethyl-2-phenyltriazine, 2 g of Disulfide compound 1-d, 170 g of 1,1-bis(2-hydroxy -3,5-dimethylphenyl)-3,5,5-trimethylhexane, 5 g of tetrachlorophthalic acid, 1.1 g of Megafax F-176P (fluorinated surface active agent, Dai-Nihon Ink Chemical Industry Co., Ltd.), 590 g of 2-butanone and 10 g of methyl isobutyl ketone were added with stirring.

<<Coating Solution For Protective Layer For Emulsion Surface>>

75 g of CAB171-15S (cellulose acetate butyrate, Eastman Chemical Products, Inc.), 5.7 g of 4-methylphthalic acid, 1.5 g of tetrachlorophthalic acid anhydride, 13.5 g of phthalazine, 0.3 g of Megafax F-176P and 2 g of Sildex H31 (spherical silica having an average size of 3 μm, Dokai Chemical K.K.) and 5 g of Sumidur N3500 (polyisocyanate, Sumitomo Bayer Urethane Co., Ltd.) were dissolved in 3070 g of 2-butanone and 30 g of ethyl acetate.

<<Coating Solution For Back Surface>>

Calcium compound 1-e was synthesized as follows. 1 L of a solution containing 0.08 mole of 3,5-di-tert-butylcatechol in ethanol was added with 167 ml of an aqueous solution containing 0.019 mole of calcium chloride and 125 ml of 25% aqueous ammonia, and bubbled with air at room temperature for 3 hours to deposit crystals of bis[2-(3,5-di-tert-butyl-o-benzoquinone monoimine)4,6-di-tert-butylphenolato]calcium (II).

12 g of polyvinyl butyral (Denka Butyral #4000-2, DENKI KAGAKUKOGYO K.K.), 12 g of CAB381-20 (cellulose acetate butyrate, Eastman Chemical Products, Inc.), 120 mg of Dye 1-f, 275 mg of Calcium compound 1-e, 320 mg of Dye 1-g, 5 mg of Dye 1-h, 0.4 g of Sildex H121 (spherical silica having an average size of 5 μm, Dokai Chemical K.K.), 0.1 g of Megafax F-176P and 2 g of Sumidur N3500 were added to 500 g of 2-butanone and 500 g of 2-propanol with stirring to mix and dissolve them.

The coating solution for emulsion layer prepared as described above was coated on a polyethylene terephthalate support having a thickness of 175 μm and tinted with Blue dye 1-i so that the coated silver amount could be 2.3 g/m$^2$. Then, the coating solution for the back surface was coated on the surface opposite the emulsion layer to have an optical density at 810 nm of 0.7. Further, the coating solution for the protective layer for emulsion surface was coated on the emulsion surface to have a dry thickness of 2 μm. The obtained thermally processed image recording material has smoothness of 1000 seconds for the emulsion surface and 80 seconds for the back surface (Beck's smoothness was determined according to the Ohken's Smoothness Measurement described in J. TAPPI, Test Methods for Paper and Pulp No. 5).

Tellurium compound 1-a
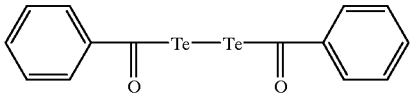
Disulfide compound 1-d
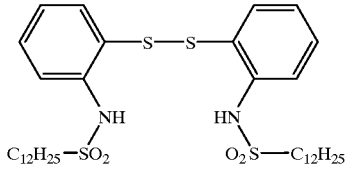
Dye 1-b
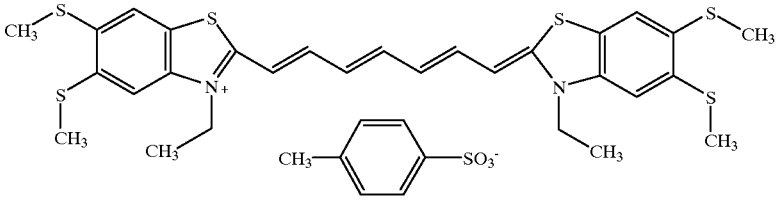
Dye 1-c
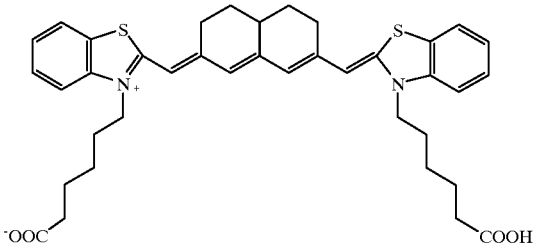
Dye 1-f
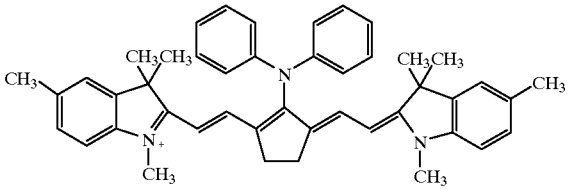
Blue dye 1-i
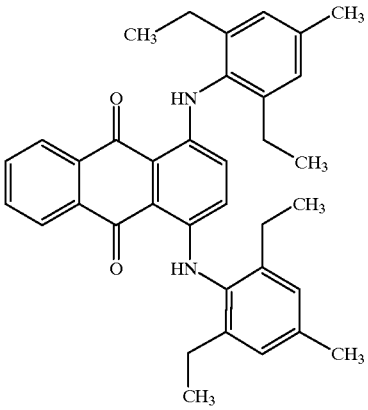
Dye 1-g
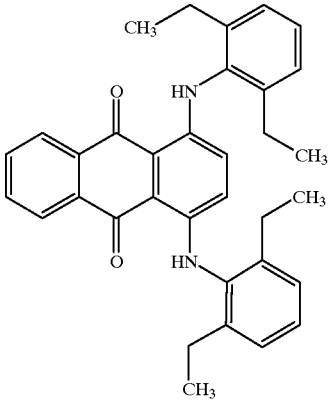
Dye 1-h
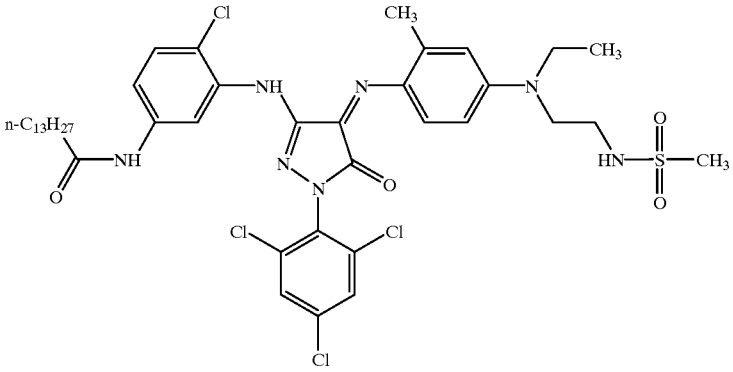

(Evaluation of Photographic Performance)

Each of the samples was light-exposed by a laser photosensitive meter provided with a diode of 820 nm, and heat-developed at 120° C. for 15 seconds, and the obtained image was evaluated by a densitometer. The samples were evaluated for Dmin and Dmin variation ratio like Example 1. The results are shown in Table 4.

TABLE 4

| Sample | Grain used | Dmin | Dmin variation ratio |
|---|---|---|---|
| A | A | 210 | 51 |
| B | B | 104 | 0 |
| C | C | 146 | 29 |
| D | D | 111 | 3 |
| E | E | 100 | 0 |
| F | F | 97 | 0 |
| G | G | 194 | 35 |
| H | H | 101 | 0 |
| I | I | 157 | 28 |
| J | J | 113 | 3 |
| K | K | 104 | 0 |
| L | L | 98 | 0 |

Also in this example, it can be understood that the samples according to the present invention showed lower Dmin and smaller Dmin variation ratios compared with the comparative samples.

The thermally processed image recording material prepared by using the aliphatic acid silver salt grains of the present invention has advantages that it shows superior fog prevention ability, in addition, excellent fog prevention ability even after time lapse, and provides good images.

Figure 1:
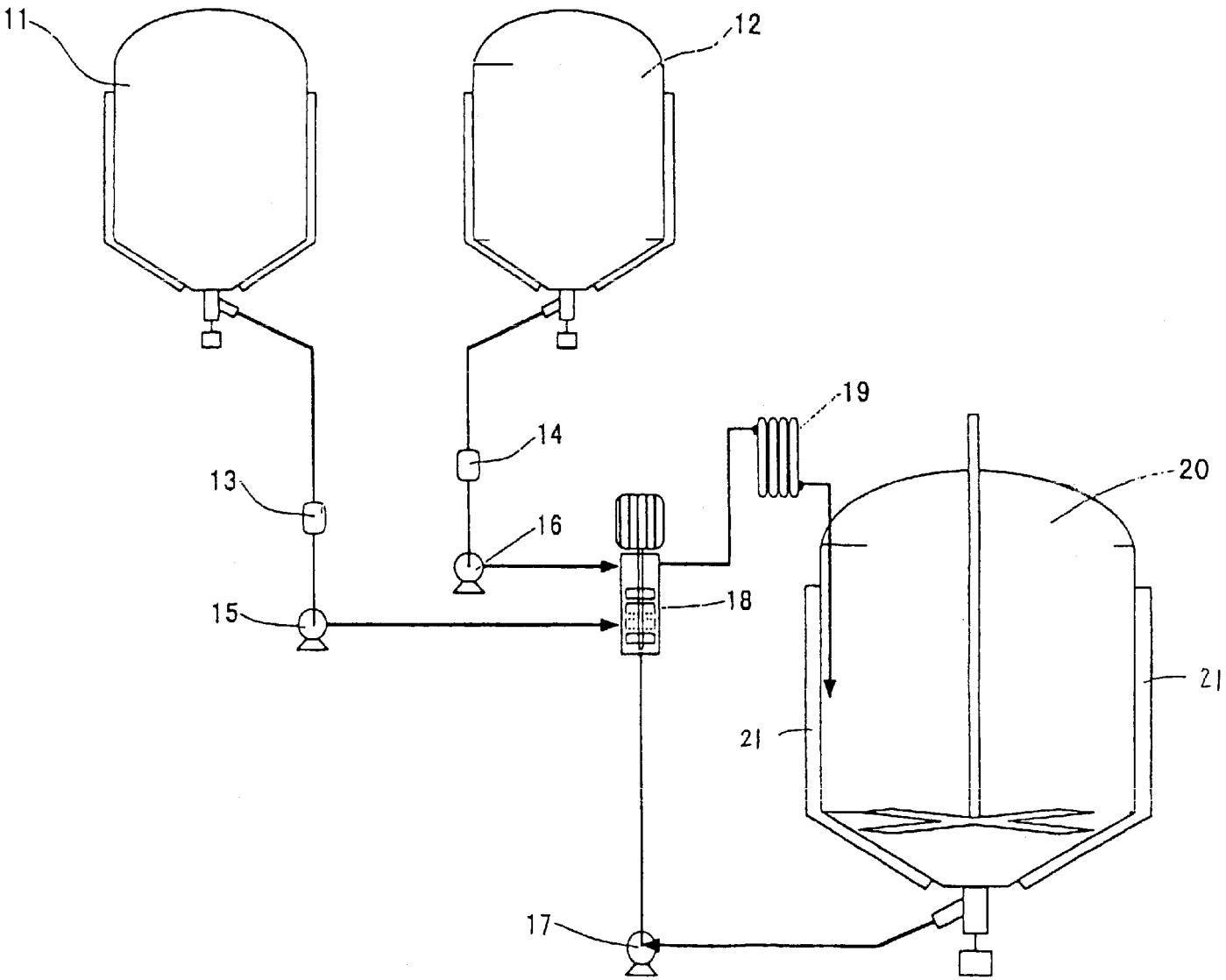
FIG. 1 is a schematic view showing an exemplary apparatus used for the preparation of aliphatic acid silver salt used in the present invention. The apparatus comprises a tank 11 for additive component 1, tank 11 for additive component 2, flow meter 13 for additive component 1, flow meter 14 for additive component 2, pump 15 for additive component 1, pump 16 for additive component 2, pump 17 for circulating produced liquid, closed mixer 18, heat exchanger 19, tank 20 for produced liquid and jacket 21.

What is claimed is:

1. A method for producing grains of aliphatic acid silver salt by mixing a solution containing silver ions and a solution of aliphatic acid alkali metal salt in a reaction field to attain reaction of them, wherein:

95–100% of the total molar number to be added of the aliphatic acid alkali metal salt is added under a condition that dilution factor of the solution of aliphatic acid alkali metal salt becomes 10-fold or higher at 1 second after addition of the solution of aliphatic acid alkali metal salt to the reaction field, 95–100% of the total amount to be added of silver in the solution containing silver ions is added under a condition that dilution factor of the solution containing silver ions becomes 20-fold or higher at 1 second after addition of the solution containing silver ions to the reaction field, and 50–100% of the total amount to be added of the solution of aliphatic acid alkali metal salt is added simultaneously with the solution containing silver ions.

2. The method for producing grains of aliphatic acid silver salt according to claim 1, wherein the solution containing silver ions and the solution of aliphatic acid alkali metal salt are added to a closed mixing means to attain the reaction.

3. The method for producing grains of aliphatic acid silver salt according to claim 1, wherein the dilution factor of the solution of aliphatic acid alkali metal salt is 15-fold or higher.

4. The method for producing grains of aliphatic acid silver salt according to claim 1, wherein the dilution factor of the solution containing silver ions is 50-fold or higher.

5. The method for producing grains of aliphatic acid silver salt according to claim 1, wherein the concentration of the aliphatic acid alkali metal salt in said solution of aliphatic acid alkali metal salt is 5–50 weight %.

6. The method for producing grains of aliphatic acid silver salt according to claim 5, wherein the concentration of the aliphatic acid alkali metal salt in said solution of aliphatic acid alkali metal salt is 7–45 weight %.

7. The method for producing grains of aliphatic acid silver salt according to claim 6, wherein the concentration of the aliphatic acid alkali metal salt in said solution of aliphatic acid alkali metal salt is 10–40 weight %.

8. The method for producing grains of aliphatic acid silver salt according to claim 1, wherein said solution of aliphatic acid alkali metal salt contains an organic solvent and water, the organic solvent being contained in an amount of 3–70 volume % relative to the volume of water.

9. The method for producing grains of aliphatic acid silver salt according to claim 8, wherein said solution of aliphatic acid alkali metal salt contains an organic solvent and water, the organic solvent being contained in an amount of 5–50 volume % relative to the volume of water.

10. The method for producing grains of aliphatic acid silver salt according to claim 1, wherein said solution containing silver ions is a solution of silver nitrate.

11. The method for producing grains of aliphatic acid silver salt according to claim 1, wherein the silver ion concentration in said solution containing silver ions is 0.03–6.5 mol/L.

12. The method for producing grains of aliphatic acid silver salt according to claim 11, wherein the silver ion concentration in said solution containing silver ions is 0.1–5 mol/L.

13. The method for producing grains of aliphatic acid silver salt according to claim 1, wherein said solution containing silver ions contains a tertiary alcohol having 4–6 carbon atoms as an solvent.

14. The method for producing grains of aliphatic acid silver salt according to claim 1, wherein said tertiary alcohol is contained in an amount of 70 volume % or less, relative to the total volume of the aqueous solution of a water-soluble silver salt.

15. The method for producing grains of aliphatic acid silver salt according to claim 1, wherein pH of the solution containing silver ions is 1–6.

16. The method for producing grains of aliphatic acid silver salt according to claim 15, wherein pH of the solution containing silver ions is 1.5–4.

17. The method for producing grains of aliphatic acid silver salt according to claim 1, which is performed by adding first said solution containing silver ions in an amount of 0.1–30% of the total amount to be added of silver and then adding said aliphatic acid alkali metal salt.

18. The method for producing grains of aliphatic acid silver salt according to claim 17, which is performed by adding first said solution containing silver ions in an amount of 0.5–20% of the total amount to be added of silver and then adding said aliphatic acid alkali metal salt.

* * * * *